US012421002B2

(12) United States Patent
Merzeau

(10) Patent No.: US 12,421,002 B2
(45) Date of Patent: Sep. 23, 2025

(54) ARTICLE CARRIER AND BLANK THEREFOR

(71) Applicant: WestRock Packaging Systems, LLC, Atlanta, GA (US)

(72) Inventor: Julien D. Merzeau, Chateauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 12 days.

(21) Appl. No.: 18/267,918

(22) PCT Filed: Dec. 15, 2021

(86) PCT No.: PCT/US2021/063613

§ 371 (c)(1),
(2) Date: Jun. 16, 2023

(87) PCT Pub. No.: WO2022/132969

PCT Pub. Date: Jun. 23, 2022

(65) Prior Publication Data

US 2024/0034532 A1 Feb. 1, 2024

Related U.S. Application Data

(60) Provisional application No. 63/244,899, filed on Sep. 16, 2021, provisional application No. 63/126,347, filed on Dec. 16, 2020.

(51) Int. Cl.
*B65D 71/42* (2006.01)

(52) U.S. Cl.
CPC .... *B65D 71/42* (2013.01); *B65D 2571/00265* (2013.01); *B65D 2571/00444* (2013.01); *B65D 2571/0066* (2013.01)

(58) Field of Classification Search
CPC ..... B65D 71/42; B65D 75/00; B65D 2571/00265; B65D 2571/00444; B65D 2571/0066; B65D 71/40; B65D 71/44
(Continued)

(56) References Cited

U.S. PATENT DOCUMENTS 5,415,278 A * 5/1995 Sutherland ..... B65D 71/46 206/148
5,553,705 A 9/1996 Bakx
(Continued)

FOREIGN PATENT DOCUMENTS

| | | |
|---|---|---|
| DE | 29813672 U1 | 11/1998 |
| EP | 0271895 A1 | 6/1988 |
| ES | 1231894 U | 7/2019 |

OTHER PUBLICATIONS

International Search Report issued in PCT/US2021/063613, mailed Jun. 24, 2022.

*Primary Examiner* — Bryon P Gehman
(74) *Attorney, Agent, or Firm* — Brian J. Goldberg; Tsugihiko Suzuki; Rohini K. Garg

(57) ABSTRACT

Aspects of the disclosure relate to an article carrier (90; 190; 390; 490) for packaging one or more articles and a blank (10; 110; 210; 310; 410; 510) for forming the carrier. The carrier (90; 190; 390; 490) comprises a main panel (12; 112; 212; 312; 412; 512) having one or more article retention structures (RT1, RT2) for receiving and securing the main panel (12; 112; 212; 312; 412; 512) to a respective article (B). The carrier (90; 190; 390; 490) comprises a side panel (18, 20; 118, 120; 218, 220; 318, 320; 418, 420, 518, 520) hingedly connected to the main panel (12; 112; 212; 312; 412; 512) by a hinged connection. The hinged connection between the main panel (12; 112; 212; 312; 412; 512) and the side panel (18, 20; 118, 120; 218, 220; 318, 320; 418, 420, 518, 520) is defined, at least in part, by a curved or arcuate fold line (13, 15, 17, 19).

49 Claims, 18 Drawing Sheets

(58) Field of Classification Search
USPC ..... 206/148
See application file for complete search history.

(56) References Cited

U.S. PATENT DOCUMENTS

| | | | | |
|---|---|---|---|---|
| 8,096,413 | B2 * | 1/2012 | Coltri De Paula .... | B65D 71/42 206/153 |
| 8,387,784 | B2 * | 3/2013 | Gonzalez ..... | B65D 71/42 206/427 |
| 8,701,878 | B2 * | 4/2014 | Spivey, Sr. ..... | B65D 71/46 206/427 |
| 2012/0285854 | A1 | 11/2012 | Spivey, Sr. | |

* cited by examiner

ARTICLE CARRIER AND BLANK THEREFOR

TECHNICAL FIELD

The present invention relates to article carriers and to blanks for forming the same. More specifically, but not exclusively, the invention relates to a carrier of the top-gripping type having one or more apertures for receiving and retaining an article therein.

BACKGROUND

In the field of packaging, it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel and are arranged about the aperture. The tabs are displaced out of the plane of said panel when an article is received in the aperture, wherein said tabs engage the article generally about a flange or lip of the article.

It is desirable that all the tabs efficiently or effectively engage the article. It is also desirable to provide a carrier with impact resistance to protect the articles.

The present invention seeks to provide an improvement in the field of cartons, typically formed from paperboard or the like.

SUMMARY

A first aspect of the invention provides an article engaging carrier for packaging at least one article. The carrier comprises a main panel having at least one article retention structure for engaging an article. The carrier comprises a side panel hingedly connected to the main panel by a hinged connection. The hinged connection between the main panel and the side panel is defined, at least in part, by an arcuate fold line.

Optionally, the main panel comprises two or more article retention structures and the arcuate fold line extends between an adjacently disposed pair of article retention structures.

Optionally, the at least one article retention structure comprises a plurality of engaging teeth for engaging an article hingedly connected to the main panel by a second hinged connection and the arcuate fold line converges with the second hinged connection.

Optionally, the at least one article retention structure comprises a plurality of engaging teeth for engaging an article hingedly connected to the main panel by a second hinged connection. The arcuate fold line is coupled to the second hinged connection by a crease line.

Optionally, a first abutment tab is struck, at least in part, from the main panel and is integral with the side panel and defines a portion of an article receiving opening of the at least one article retention structure. The arcuate fold line converges with the article receiving opening proximate the first abutment tab.

Advantageously, abutment tabs may facilitate folding of the side panel with respect to the main panel.

Optionally, an article engaging tooth is disposed adjacent to the first abutment tab, the article engaging tooth being struck, at least in part, from the main panel and hinged thereto by a second hinged connection. The arcuate fold line converges with the second hinged connection proximate the abutment tab.

Optionally, the carrier comprises an end panel hingedly connected to the main panel, at least in part, by a second arcuate fold line.

Optionally, a second abutment tab is struck, at least in part, from the main panel and is integral with the end panel. The second abutment tab defines a portion of an article receiving opening of the at least one article retention structure. The second arcuate fold line converges with the article receiving opening proximate the second abutment tab.

Optionally, the second abutment tab is perpendicular to the first abutment tab.

A second aspect of the invention provides an article engaging carrier for packaging at least one article. The carrier comprises a main panel having at least one article retention structure comprising a plurality of teeth for engaging an article. The carrier comprises a side panel hingedly connected to the main panel by a first hinged connection and having a first free edge opposing the hinged connection. The first hinged connection between the main panel and the side panel is defined, at least in part, by a linear fold line. A further hinged connection between one of the plurality of teeth and the main panel is arranged to converge with the linear fold line.

Optionally, said further hinged connection between said one of the plurality of teeth and the main panel is spaced apart from the linear fold line.

Optionally, the plurality of teeth defines a circumferential fold line surrounding an article receiving opening and defining an outer perimeter thereof, and wherein the circumferential fold line is spaced apart from the linear fold line.

Optionally, the article engaging carrier further comprises an end panel hingedly connected to the main panel by a second hinged connection and having a second free edge opposing the second hinged connection, the end panel being disposed adjacent to the side panel, wherein the end panel comprises a rounded corner providing a portion of the second free edge and wherein the side panel comprises a squared corner providing a portion of the first free edge.

A third aspect of the invention provides an article engaging carrier for packaging at least one article. The carrier comprises a main panel having at least one article retention structure for engaging an article. The carrier comprises a side panel hingedly connected to the main panel by a first hinged connection, and an end panel hingedly connected to the main panel adjacent to the side panel by a second hinged connection. A portion of the first hinged connection and a portion of the second hinged connection define, at least in part, a corner portion of the main panel. The portion of the first hinged connection is obliquely oriented, at least in part, with respect to the portion of the second hinged connection.

Optionally, the at least one article retention structure comprises an article receiving opening disposed adjacent to the side and end panels and the portion of the first hinged connection extends between an end of the side panel and the article receiving opening and a portion of the second hinged connection extends between an end of the end panel and the article receiving opening.

Optionally, the portion of the first hinged connection and the portion of the second hinged connection define an angle therebetween, the angle is obtuse or greater than 90°.

Optionally, the corner portion of the main panel is inclined with respect to the main panel.

Optionally, one or both of the portions of the first and second hinged connections is linear.

A fourth aspect of the invention provides an article engaging carrier for packaging at least one article. The carrier comprises a main panel having at least one article retention structure for engaging an article. The carrier comprises a side panel hingedly connected to the main panel by a first hinged connection and an end panel hingedly connected to the main panel adjacent to the side panel by a second hinged connection. A portion of the first hinged connection and a portion of the second hinged connection define, at least in part, a corner portion of the main panel. A corner bumper panel is hingedly connected between an end of the side panel and an adjacent end of the end panel.

Optionally, the corner bumper panel is separated from the corner portion of the main panel by a severance line.

Optionally, the corner bumper panel is inclined with respect to the main panel.

Optionally, the at least one article retention structure comprises an article receiving opening disposed adjacent to the side and end panels. The portion of the first hinged connection extends between the corner bumper panel and the article receiving opening and a portion of the second hinged connection extends between corner bumper panel and the article receiving opening.

A fifth aspect of the invention provides an article engaging carrier for packaging at least one article. The carrier comprises a first panel having at least one article retention structure for receiving an article and a second panel hingedly connected to the first panel. The at least one article retention structure comprises an article receiving opening. The article receiving opening is defined, at least in part, by an abutment tab integral with the second panel.

Optionally, the abutment tab is arranged to engage a side portion of an article.

Optionally, the abutment tab comprises an abutment face for abutting a portion of the article.

Optionally, the abutment tab comprises a free edge disposed opposite a hinged edge; the free edge is arranged to be disposed below an engagement feature of an article to provide support thereto.

Optionally, the at least one article retention structure comprises a series of engaging teeth each struck, at least in part, from the main panel and disposed about the perimeter of an article receiving aperture defined in the first panel, the series of teeth and the article receiving aperture define, at least in part, the article receiving opening.

Optionally, each of the series of engaging teeth comprises an engaging edge disposed opposite a hinged edge for engaging an article below an engagement feature of an article.

Optionally, the abutment tab comprises an engaging edge opposing a hinged edge, the engaging edge being arranged to engage an article when received in the at least one article retention structure.

Optionally, the at least one article retention structure comprises a plurality of engaging teeth disposed about the article receiving opening.

Optionally, the plurality of engaging teeth comprises at least two teeth having different widths.

Optionally, the abutment tab forms an engaging tooth and has a different width to either of the at least two teeth.

Optionally, the plurality of engaging teeth comprises three first teeth and two second teeth, the three first teeth being disposed between the pair of second teeth, and wherein the second teeth have a larger width than the first teeth.

Optionally, the abutment tab forms one of the pair of second teeth.

Optionally, the article engaging carrier further comprises a third panel hingedly connected to the first panel and disposed adjacent to the second panel, and wherein the article receiving opening is defined, at least in part, by a second abutment tab integral with the third panel.

Optionally, the second abutment tab forms a second one of the pair of second teeth.

Optionally, each of the plurality of engaging teeth is defined by at least one first radial cutline, and the plurality of engaging teeth defines a circumferential fold line surrounding the article receiving opening and defining an outer perimeter thereof, and wherein the abutment tab is defined by at least one second radial cutline, the second radial cut line extending into the engaging panel beyond the outer perimeter defined by the circumferential fold line.

Optionally, a hinged connection between the first panel and the second panel is defined at least in part by a plurality of cuts, the plurality of cuts including at least two, three or more cuts of different lengths.

Optionally, the plurality of cuts is provided between an abutment tab of a first article retention structure and an abutment tab of a second article retention structure.

A sixth aspect of the invention provides an article engaging carrier for packaging at least one article. The carrier comprises a first panel having at least one article retention structure for receiving an article and a second panel hingedly connected to the first panel. The at least one article retention structure comprises a series of teeth each struck, at least in part, from the first panel and disposed about the perimeter of an article receiving aperture. The series comprises a first tooth integral with the second panel and disposed opposite a recess interrupting the series of engaging teeth.

Optionally, the recess defines a gap in the series of teeth.

A seventh aspect of the invention provides an article engaging carrier for packaging at least one article. The carrier comprises a main panel having at least one article retention structure for receiving an article having an engagement feature of circular cross-section. The at least one article retention structure comprises a series of engaging teeth each struck, at least in part, from the main panel and disposed about the perimeter of an article receiving aperture. The series of teeth and the article receiving aperture define an article receiving opening. The series of teeth comprises at least one group of teeth hingedly connected to the main panel. The group of teeth is hinged to the main panel by a non-circular fold line.

Optionally, the fold line is defined by a portion of one of the shapes selected from the following group: an ellipse, superellipse, hyperellipse, squircie, and rounded square.

An eighth aspect of the invention provides a blank for forming an article carrier. The blank comprises a main panel having at least one article retention structure for engaging an article. The blank comprises a side panel hingedly connected to the main panel by a hinged connection. The hinged connection between the main panel and the side panel is defined, at least in part, by an arcuate fold line.

A ninth aspect of the invention provides a blank for forming an article carrier. The blank comprises a main panel having at least one article retention structure comprising a plurality of teeth for engaging an article. The blank comprises a side panel hingedly connected to the main panel by a hinged connection and having a free edge opposing the hinged connection. The hinged connection between the main panel and the side panel is defined, at least in part, by a linear fold line. A hinged connection between one of the plurality of teeth and the main panel is arranged to converge with the linear fold line.

A tenth aspect of the invention provides a blank for forming an article carrier. The blank comprises a main panel having at least one article retention structure for engaging an article. The blank comprises a side panel hingedly connected to the main panel by a first hinged connection, and an end panel hingedly connected to the main panel adjacent to the side panel by a second hinged connection. A portion of the first hinged connection and a portion of the second hinged connection define, at least in part, a corner portion of the main panel. The portion of the first hinged connection is obliquely oriented, at least in part, with respect to the portion of the second hinged connection.

An eleventh aspect of the invention provides a blank for forming an article carrier. The blank comprises a main panel having at least one article retention structure for engaging an article. The blank comprises a side panel hingedly connected to the main panel by a first hinged connection and an end panel hingedly connected to the main panel adjacent to the side panel by a second hinged connection. A portion of the first hinged connection and a portion of the second hinged connection define, at least in part, a corner portion of the main panel. A corner bumper panel is hingedly connected between an end of the side panel and an adjacent end of the end panel.

A twelfth aspect of the invention provides a blank for forming an article carrier. The blank comprises a first panel having at least one article retention structure for receiving an article and a second panel hingedly connected to the first panel. The at least one article retention structure comprises an article receiving opening. The article receiving opening is defined, at least in part, by an abutment tab integral with the second panel.

A thirteenth aspect of the invention provides a blank for forming an article carrier. The blank comprises a first panel having at least one article retention structure for receiving an article and a second panel hingedly connected to the first panel. The at least one article retention structure comprises a series of teeth each struck, at least in part, from the first panel and disposed about the perimeter of an article receiving aperture. The series comprises a first tooth integral with the second panel and disposed opposite a recess interrupting the series of teeth.

A fourteenth aspect of the invention provides a blank for forming an article carrier. The blank comprises a main panel having at least one article retention structure for receiving an article having an engagement feature of circular cross-section. The at least one article retention structure comprises a series of engaging teeth each struck, at least in part, from the main panel and disposed about the perimeter of an article receiving aperture. The series of teeth and the article receiving aperture define an article receiving opening. The series of teeth comprises at least one group of teeth hingedly connected to the main panel. The group of teeth is hinged to the main panel by a non-circular fold line.

A fifteenth aspect of the invention provides an article engaging carrier for packaging at least one article. The carrier comprises a first panel having at least one article retention structure for receiving an article and a second panel hingedly connected to the first panel. The at least one article retention structure comprises a series of engaging teeth each struck, at least in part, from the first panel and disposed about the perimeter of an article receiving aperture. The series is interrupted by a first abutment tab, integral with the second panel, and by recess a disposed opposite the first abutment tab.

A sixteenth aspect of the invention provides an article engaging carrier for packaging at least one article. The carrier comprises a main panel having at least one article retention structure for receiving an article and suspending the article therefrom. The at least one article retention structure comprises an article receiving opening. The article receiving opening is defined, at least in part, by a first cutaway adjacent to a longitudinal edge of the main panel and by a second cutaway adjacent to a lateral edge of the main panel. The article retention structure comprises two or more tabs disposed between the first and second cutaway.

Optionally, at least one of the first and second cutaways is defined by a recess adjacent to a free or unhinged edge of the main panel.

Optionally, at least one of the first and second cutaways is defined by an abutment tab adjacent to a hinged edge of the main panel, the hinged edge being defined by a hinged connection between the main panel and a second panel.

Optionally, the abutment tab extends from the second panel and is integral therewith.

Optionally, the abutment tab forms an engaging tooth for supporting an article disposed in the article retention structure.

Optionally, at least one of the first and second cutaways is wider in dimension than the tabs.

Optionally, the two or more tabs disposed are disposed across a corner of the main panel.

Optionally, each of the two or more tabs forms an engaging tab for supporting or suspending an article disposed in the article retention structure.

Optionally, the carrier comprises at least one second article retention structure disposed adjacent to the at least one article retention structure. The at least one second article retention structure comprises a second article receiving opening struck from the main panel. The second article receiving opening is defined, at least in part, by a cutaway adjacent to the longitudinal edge of the main panel. The article retention structure comprises two or more tabs disposed about the second article receiving opening.

A seventeenth aspect of the invention provides a blank for forming an article carrier. The blank comprises a main panel having at least one article retention structure for receiving an article and suspending the article therefrom. The at least one article retention structure comprises an article receiving opening. The article receiving opening is defined, at least in part, by a first cutaway adjacent to a longitudinal edge of the main panel and by a second cutaway adjacent to a lateral edge of the main panel. The article retention structure comprises two or more tabs disposed between the first and second cutaway.

Further features and advantages of the present invention will be apparent from the specific embodiments illustrated in the drawings and discussed below.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
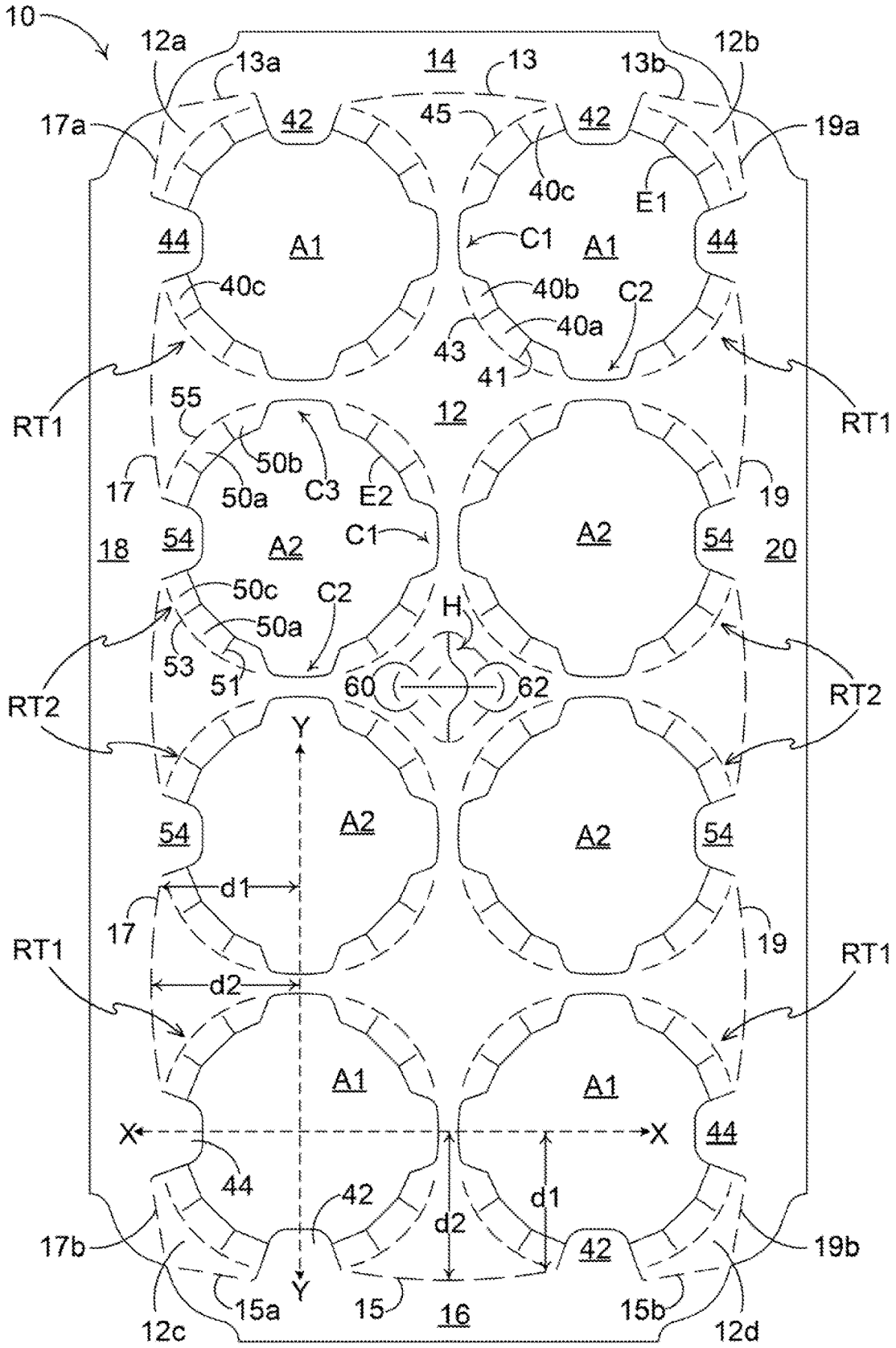
FIG. 1 is a plan view from above of a blank for forming a carrier according to a first embodiment.
Figure 2:
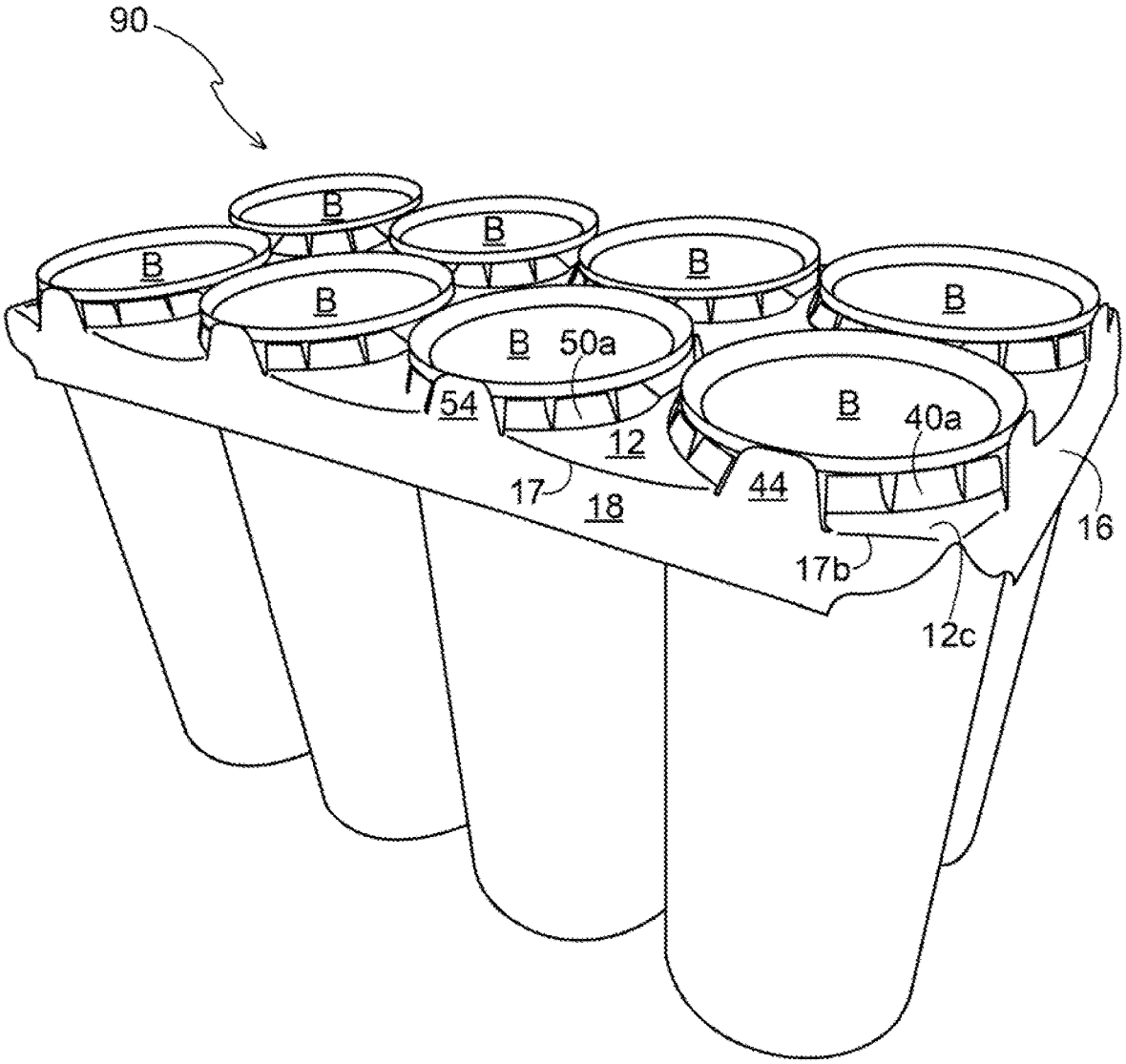
FIG. 2 is a perspective view from above of a carrier formed from the blank of FIG. 1.

Referring to FIG. 1, there is shown a plan view of a blank 10 which is capable of forming a carton or carrier 90, as shown in FIG. 2, for containing and carrying a group of primary products such as, but not limited to, bottles or cans, hereinafter referred to as articles B, as shown in FIG. 2. The articles B may be generally cylindrical; the articles B may comprise a circular cross-sectional shape, at least about a region of engagement with the carrier 90. The blank 10 forms a secondary package for packaging at least one primary product container or package. Alternative blanks 110; 210; 310; 410; 510; 610; 710; 810 are shown in FIGS. 3 to 16 for forming an alternative carton or carriers 190; 390; 490; 690; 790; 890.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10; 110; 210; 310; 410; 510; 610; 710; 810 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110; 210; 310; 410; 510; 610; 710; 810 are configured to form a carton or carrier 90; 190; 390; 490; 690; 790 for packaging an exemplary arrangement of exemplary articles B. In the embodiments illustrated in FIGS. 1 to 10, the arrangement is a 2×4 matrix or array—two rows of four articles B are provided—and the articles B are beverage cans. In the embodiments illustrated in FIGS. 11 to 16, the arrangement is a 2×3 matrix or array—two rows of three articles B are provided—and the articles B are beverage cans. Alternatively, the blanks 10; 110; 210; 310; 410; 510; 610; 710; 810 can be configured to form a carrier for packaging other types, number and size of articles and/or for packaging articles in a different arrangement or configuration.

In the embodiments illustrated in FIGS. 1 to 7 and 10, the blanks 10; 110; 210; 310; 510 are configured to accommodate beverage cans of the sleek or slim design that may be 330 ml cans. The articles B are substantially of the same diameter over their entire height. An exemplary article B has a maximum diameter or lateral dimension (the diameter may be about 2.25 inches or about 58 mm). The article B comprises an upper portion or top closure which has a diameter or lateral dimension (the diameter may be about 2.125 inches or 54.8 mm).

The neck may provide an outwardly projecting flange, that is to say it may comprise an undercut for engaging with the carrier. A top closure may be attached to the side wall of the article B to form a seam or "chime" which provides the flange. In some embodiments, the variation in diameter between the top closure and the main body of the article B is less than 7 mm, may be less than 5 mm and optionally is less than 4 mm.

As used herein the terms "sleek" or "slim" refer to articles B which have little or no variation in their lateral dimension between the top closure, which engages with the carrier 90; 190; 390, and the main body of the article B. The articles B are substantially parallel sided or of substantially uniform diameter.

Figure 8:
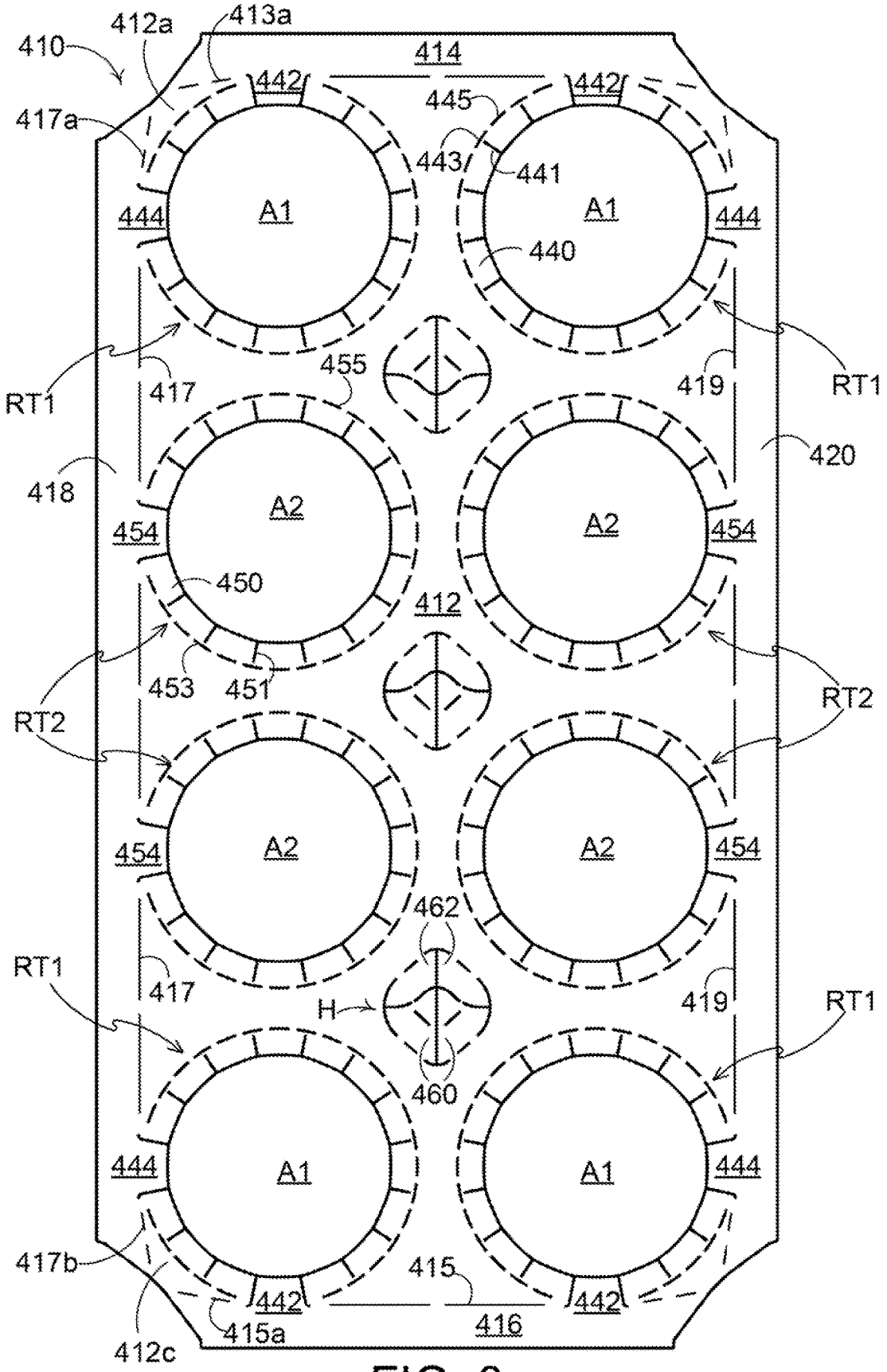
FIG. 8 is a plan view from above of a blank for forming a carrier according to a fifth embodiment.
Figure 9:
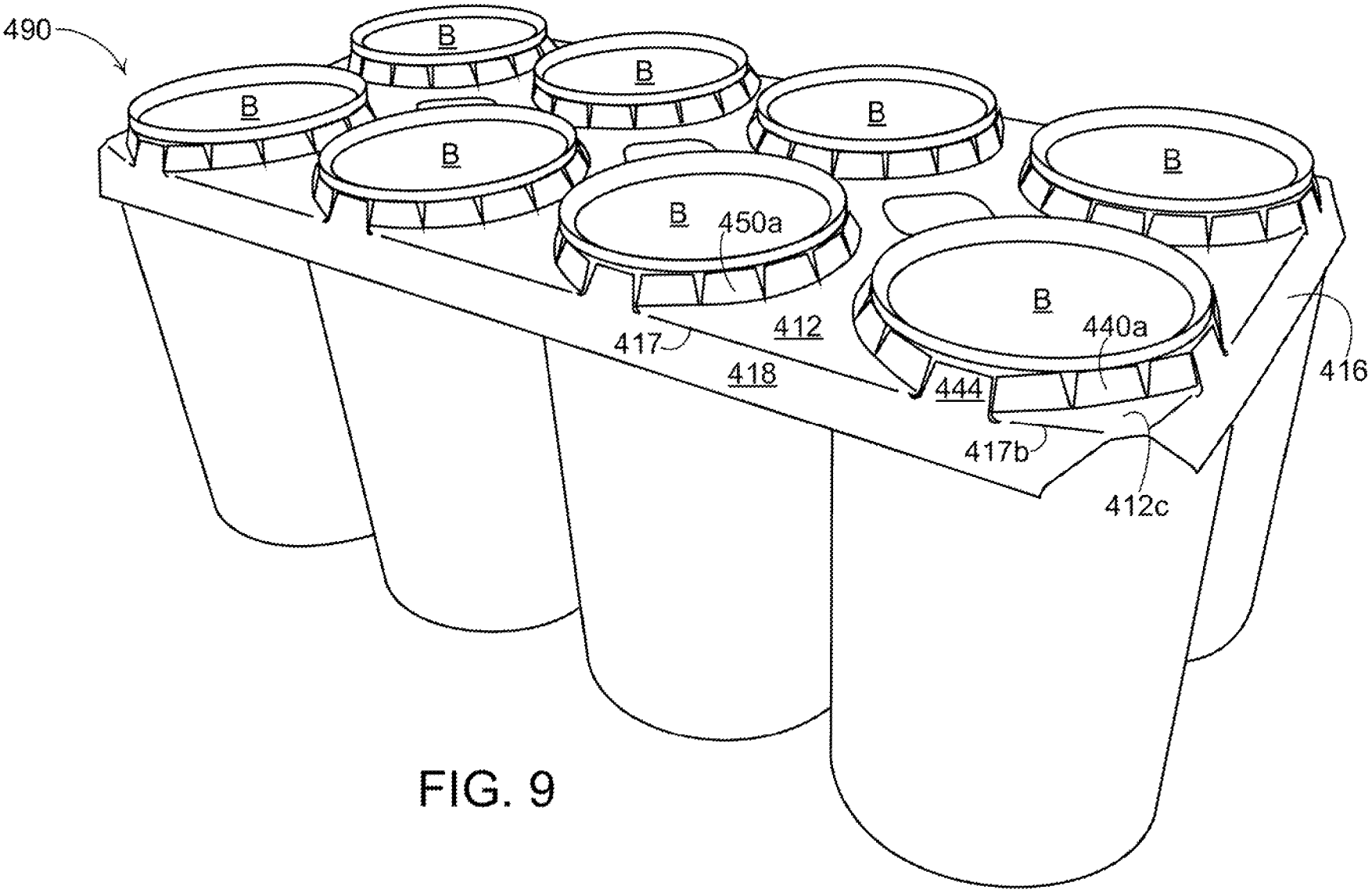
FIG. 9 is a perspective view from above of a carrier formed from the blank of FIG. 8.

In the embodiments illustrated in FIGS. 8 and 9, the beverage cans may be of a different size and profile for example, but not limited to, 350 ml beverage cans. An exemplary article B has a maximum diameter or lateral dimension (the diameter may be about 2.6 inches or about 68 mm). The article B comprises an upper portion or top closure which has a diameter or lateral dimension (the diameter may be about 2.125 inches or 54.8 mm). In some embodiments, the variation in diameter between the top closure and the main body of the article B is greater than 7 mm, may be 10 mm or more and optionally may be at least 12 mm.

In the embodiments illustrated in FIGS. 11 to 16, the beverage cans may be of a different size and profile for example, but not limited to, 330 ml beverage cans. An exemplary article B has a maximum diameter or lateral dimension (the diameter may be about 2.6 inches or about 66 mm). The article B comprises an upper portion or top closure which has a diameter or lateral dimension (the diameter may be about 2.125 inches or 54.8 mm). In some embodiments, the variation in diameter between the top closure and the main body of the article B is greater than 7 mm, may be 10 mm or more and optionally may be at least 12 mm. The articles B employed or packaged by the embodiments of FIG. 11 to 16 may have a different height dimension to the articles B employed or packaged by the embodiments of FIGS. 8 and 9.

Referring to FIG. 1 there is shown a blank 10 comprising a plurality of panels 12, 14, 16, 18, 20, including a main panel 12 for forming a top wall or an engaging panel of a carrier 90 (see FIG. 2).

The blank 10 includes a first end panel 14 hingedly connected to a first end of the main panel 12 by a hinged connection in the form of a fold line 13. The blank 10 includes a second end panel 16 hingedly connected to a second side of the main panel 12 by a hinged connection in the form of a fold line 15.

The blank 10 includes a first side panel 18 hingedly connected to a first side of the main panel 12 by a hinged connection in the form of a fold line 17. The blank 10 includes a second side panel 20 hingedly connected to a second side of the main panel 12 by a hinged connection in the form of a fold line 19.

The main panel 12 includes at least one article retention structure RT1, RT2. In the illustrated embodiment, the main panel 12 comprises a plurality of article retention structures RT1, RT2 specifically eight article retention structures RT1, RT2 arranged in 4×2 matrix or array. The main panel 12 comprises two columns of article retention structures RT1, RT2, each column comprises four article retention structures RT1, RT2. The main panel 12 comprises four rows of article retention structures RT1, RT2, each row comprises two article retention structures RT1, RT2. Each of the article retention structures RT1, RT2 may comprise an aperture A1, A2.

The blank 10 comprises four first article retention structures RT1. The first article retention structures RT1 are located adjacent to ends of the main panel 12. The blank 10 comprises four second article retention structures RT2. The second article retention structures RT2 are located between a first pair of first article retention structures RT1 disposed proximate a first end of the main panel 12 and a second pair of first article retention structures RT1 disposed proximate a second end of the main panel 12. The second article retention structures RT2 are also referred to herein as intermediate article retention structures RT2. The first article retention structures RT1 are also referred to herein as end article retention structures RT1.

Each of the first article retention structures RT1 is substantially similar in construction and will therefore be described in detail with reference to a first one of the first article retention structures RT1 located adjacent to a first end of the blank 10 as shown in FIG. 1. The first article retention structure RT1 comprises an article receiving opening defined in part by an aperture A1. The first article retention structure RT1 comprises a plurality of engaging teeth 40*a*, 40*b*, 40*c* disposed about the aperture A1.

The plurality of teeth 40*a*, 40*b*, 40*c* are hinged to the main panel 12 by a fold line. The fold line may be defined by a plurality of cut lines 43, 45. The plurality of cut lines 43, may define or approximate a squircle or rounded square.

The first article retention structure RT1 comprises a plurality of first or full teeth 40*a* disposed about the aperture A1. Each of the plurality of first teeth 40*a* comprises an engaging edge E1 opposing a hinged edge. The engaging edges E1 are defined by a linear portion of a cut line defining the aperture A1. Each engaging edge E1 defines a part of a polygon. The illustrated embodiment comprises four first teeth 40*a*. Each tooth 46 comprises a pair of side edges, the side edges are defined by cut lines 41 extending radially outward from respective vertices of the polygon. That is to say from a respective vertex between a pair of adjacent linear portions of the cut line defining the aperture A1. The cut lines 41 are divergently arranged with respect to each other and define an angle therebetween, the angle may be about 22.5°.

The first article retention structure RT1 comprises a plurality of first circumferential cut lines 43. Each of the plurality of first circumferential cut lines 43 is aligned with one of the radial cut lines 41 such that said one of the radial cut lines 41 or a notional extension thereof bisects a respective one of the plurality of first circumferential cut lines 43.

Each of the plurality of first circumferential cut lines 43 is spaced apart from said one of the radial cut lines 41 bisecting it so as to define a connecting nick or bridge portion between a pair of adjacently disposed teeth 40*a*, 40*b*, 40*c*. Each of the plurality of first circumferential cut lines 43 may be linear in shape. In alternative embodiments, each of the plurality of first circumferential cut lines 43 may be arcuate or curved.

The first article retention structure RT1 comprises a plurality of second circumferential cut lines 45. Each of the plurality of second circumferential cut lines 45 is disposed between a pair of the plurality of first circumferential cut lines 43 and is spaced apart therefrom so as to define a pair of connecting nick or bridge portions between each tooth 40*a*, 40*b*, 40*c* and the main panel 12. The pair of connecting nick or bridge portions provide a hinged or foldable connection between each tooth 40*a*, 40*b*, 40*c* and the main panel 12.

Each of the plurality of second circumferential cut lines 45 may be linear in shape. In alternative embodiments, each of the plurality of second circumferential cut lines 45 may be arcuate or curved.

In the illustrated embodiment, the radius of curvature of each of the plurality of second circumferential cut lines 45 is equal to the radius of curvature of each of the plurality of first circumferential cut lines 43 however in other embodiments it may be different.

Optionally, the plurality of teeth 40*a*, 40*b*, 40*c* is interrupted by a first recess or cutaway C1. The first recess C1 lies upon a first notional line. First notional line extends radially through the centre of the aperture A1 and passes through the centre of the first recess C1. The first notional line extends transversely of the blank 10. The first notional line may extend along the grain of the blank 10. The first notional line may be oriented parallel with respect to the grain direction.

Optionally, the plurality of teeth 40*a*, 40*b*, 40*c* is interrupted by a second recess or cutaway C2. The second recess C2 lies upon a second notional line. Second notional line extends radially from the centre of the aperture A1 and passes through the centre of the second recess C2. The second notional line extends longitudinally of the blank 10. The second notional line may extend across the grain of the blank 10. The second notional line may be oriented perpendicularly with respect to the grain direction.

The first recess C1 is dimensioned so as to occupy a first arc defined by a first minor sector. The first minor sector is defined in part by a first sector notional line extending radially from the centre of the aperture A1 and passing through a side edge of a first partial tooth 40*b* disposed adjacent a first side of the first recess C1 and in part by a second sector notional line extending radially from the centre of the aperture A1 and passing through a side edge of a second partial tooth 40*b* disposed adjacent a second, opposing, side of the first recess C1.

The second recess C2 is dimensioned so as to occupy a second arc defined by a second minor sector. The second minor sector is defined in part by a third sector notional line extending radially from the centre of the aperture A1 and passing through a side edge of a third partial tooth 40*b* disposed adjacent a first side of the second recess C2 and in part by a fourth sector notional line extending radially from the centre of the aperture A1 and passing through a side edge of a fourth partial tooth 40*b* disposed adjacent a second, opposing, side of the second recess C2.

The first and third sector notional lines define a first toothed sector or arc therebetween. The second and fourth sector notional lines define a second toothed sector or arc therebetween.

The first article retention structure RT1 comprises at least one tab 42, 44. The illustrated embodiment comprises a pair of tabs 42, 44. The tabs 42, 44 are located orthogonally to each other about the perimeter of the opening. The tabs 42, 44 may engage an article received in first article retention structure RT1, the tabs 42, 44 do not support or bear the load (or part thereof) of the article B.

The tabs 42, 44 facilitate folding of the side and end panels 14, 16, 18, 20 and/or retention of the side and end panels 14, 16, 18, 20 in a folded condition.

Each of the first article retention structures RT1 comprises at least one first tab 42 integral with one of the first and second end panels 14, 16. The first tab 42 is disposed opposite the second recess C2. A centre of first tab 42 lies upon the second notional line.

Each of the first article retention structures RT1 comprises at least one second tab 44 integral with one of the first and second side panels 18, 20. The second tab 44 is disposed opposite the first recess C1. A centre of second tab 44 lies upon the first notional line.

The first and second tabs 42, 44 are defined, at least in part, by a cut line. The cut line is substantially 'U' shaped. The cut line is asymmetric. The cut line comprises a base portion defining a portion of the aperture A1 and a pair of leg portions extending therefrom. A first one of the leg portions is longer than a second one of the leg portions. The first leg portion may terminate in a 'J' or 'C' shaped cut. The first leg portion is disposed in closer proximity to a corner of the main panel 12 than the second leg portion.

The first article retention structures RT1 comprises second partial teeth 40*c* disposed upon opposing sides of each of the first and second tabs 42, 44. The second partial teeth 40*c* are separated from one of the first or second tabs 42, 44 by one of the first or second leg portions of the 'U' shaped cut line.

The first and second tabs 42, 44 are longer or taller in height than the engaging teeth 40*a*, 40*b*, 40*c*. The first and second tabs 42, 44 can be considered to extend into the aperture A1 so as to reduce the width or radius of the aperture A1. The plurality of first and second circumferential cut lines 43, 45 define an opening having non-circular shape. The opening may be a squircle or truncated circle.

The full teeth 40*a* may have a radial height dimension which is constant over an arc or sector which they define. The hinged connection of each full tooth 40*a* may define a portion of a circle or may define a portion of a squircle.

The partial teeth 40*b*, 40*c* may have a radial height dimension that varies across their width. The height of the partial teeth 40*b*, 40*c*, the distance between the hinged connection to the main panel 12 and the opposing free edge defined by the aperture A1 may reduce as towards a recess C1, C2 or tabs 42, 44.

The first article retention structures RT1 comprise discrete groups of teeth 40*a*, 40*b*, 40*c*, defined between a pair of recess C1, C2, between a pair of tabs 42, 44 or between one of the recesses C1, C2 and one of the tabs 42, 44. Each group of teeth 40*a*, 40*b*, 40*c* may comprise one full tooth 40*a* and a pair of partial teeth 40*b*, 40*c*. A partial tooth 40*b*, 40*c* may be disposed on opposite sides of the full tooth 40*a* and separated therefrom by a radial cut line 41. The first article retention structures RT1 may comprise at least one, two or more discrete groups of at least two, three, or more teeth 40*a*, 40*b*, 40*c*.

Each group of teeth 40*a*, 40*b*, 40*c* is hinged to the main panel 12 by a hinged connection the hinged connection is non-circular in shape, and may be defined by a portion of a squircle, truncated circle, flattened circle or rounded square. The shape may be or approximate a superellipse or hyperellipse.

Each of the second article retention structures RT2 is substantially similar in construction and will therefore be described in detail with reference to a first one of the second article retention structures RT2 located adjacent to the first one of the first article retention structures RT1 as shown in FIG. 1. The second article retention structure RT2 comprises an article receiving opening defined in part by a second aperture A2. The second article retention structure RT2 comprises a plurality of teeth 50*a*, 50*b*, 50*c* disposed about the second aperture A2.

The plurality of teeth 50*a*, 50*b*, 50*c* are hinged to the main panel 12 by a fold line. The fold line may be defined by a plurality of cut lines 53, 55. The plurality of cut lines 53, 55 may define or approximate a squircle.

The second aperture A2 comprises a plurality of first or full teeth 50*a* disposed about the second aperture A2. Each of the plurality of first teeth 50*a* comprises an engaging edge E2 opposing a hinged edge. The engaging edges E2 are defined by a linear portion of a cut line defining the second aperture A2. Each engaging edge E2 defines a part or side of a polygon. The illustrated embodiment comprises four first teeth 50*a* together defining a portion of a polygon. Each tooth 50*a* comprises a pair of side edges, the side edges are defined by cut lines 51 extending radially outward from respective vertices of the polygon. That is to say from a respective vertex between a pair of adjacent linear portions of the cut line defining the second aperture A2. The cut lines 51 are divergently arranged with respect to each other and define an angle therebetween, the angle may be about 22.5°.

The second article retention structure RT2 comprises a plurality of first circumferential cut lines 53. Each of the plurality of first circumferential cut lines 53 is aligned with one of the radial cut lines 51 such that said one of the radial cut lines 41, or a notional extension thereof, bisects a respective one of the plurality of first circumferential cut lines 53.

Each of the plurality of first circumferential cut lines 53 is spaced apart from said one of the radial cut lines 41 bisecting it so as to define a connecting nick or bridge portion between a pair of adjacently disposed teeth 50*a*, 50*b*, 50*c*. The connecting nick or bridge portion is disposed proximate a base of the teeth 50*a*, 50*b*, 50*c*. Each of the plurality of first circumferential cut lines 53 may be linear in shape.

The second article retention structure RT2 comprises a plurality of second circumferential cut lines 55. Each of the plurality of second circumferential cut lines 55 is disposed between a pair of the plurality of first circumferential cut lines 53 and is spaced apart therefrom so as to define a pair of connecting nick or bridge portions between each tooth 50*sa*, 50*b*, 50*c* and the main panel 12. The pair of connecting nick or bridge portions provide a hinged or foldable connection between each tooth 50*a*, 50*b*, 50*c* and the main panel 12. Each of the plurality of second circumferential cut lines 55 may be linear in shape.

The plurality of teeth 50*a*, 50*b*, 50*c* is interrupted by a first recess or cutaway C1, by a second recess or cutaway C2 and by a third recess or cutaway C3. The second and third recesses C2, C3 each lie upon the second notional line extending longitudinally of the blank 10. The second notional line extends radially from the centre of the second aperture A2 and passes through the centre of each of the second and third recesses C2, C3.

The first and second recesses C1, C2 are substantially similar in construction and arrangement to the first and second recesses C1, C2 of the first article retention structures RT1. The third recess is substantially similar in construction and arrangement to the second recess C1, C2 albeit in opposition thereto. The second and third recesses C2, C3 are diametrically opposed to each other.

The first recess C1 is oriented or disposed substantially orthogonally to the second and third recesses C2, C3.

The centres of the second and third recesses C2, C3 of the second article retention structure RT2 are collinear with the centre of the second recess C2 of the first article retention structure RT1.

The third recess C3 of the second article retention structure RT2 is disposed proximate to the second recess C2 of the first article retention structure RT1 and is oriented in opposition thereto.

Each of the first recesses C1 of the second article retention structures RT2 is disposed proximate to a first recess C1 of an adjacently disposed second article retention structures RT2, and is oriented in opposition thereto.

Each of the first recesses C1 of the first article retention structures RT1 is disposed proximate to a first recess C1 of an adjacently disposed first article retention structures RT1, and is oriented in opposition thereto.

The second article retention structure RT2 comprises at least one tab 54. The illustrated embodiment comprises a single tab 54. The tab 54 may engage an article received in second article retention structure RT2, the tab 54 does not support or bear the load (or part thereof) of the article B. The tab 54 facilitates folding of one of the side panels 18, 20 and/or retention of the side panels 18, 20 in a folded condition.

Each of the second article retention structure RT2 comprises at tab 54 integral with one of the first and second side panels 18, 20. The tab 54 is disposed opposite the first recess C1. A centre of tab 54 lies upon the first notional line.

The tabs 54 are defined, at least in part, by a cut line. The cut line is substantially 'U' shaped. The cut line is symmetric. The cut line comprises a base portion defining a portion of the aperture A2 and a pair of leg portions extending therefrom. A first one of the leg portions is equal in length to a second one of the leg portions.

The second article retention structure RT2 comprises second partial teeth 50*c* disposed upon opposing sides of the tab 54. The second partial teeth 50*c* are separated from the tab 54 by one of the first or second leg portions of the 'U' shaped cut line.

The tab 54 is longer or taller in height than the engaging teeth 50*a*, 50*b*, 50*c*. The tab 54 can be considered to extend into the aperture A2 so as to reduce the width or radius of the aperture A2.

The plurality of first and second circumferential cut lines 53, 55 define an opening having non-circular shape. The opening may be a squircle or truncated circle.

The full teeth 50*a* may have a radial height dimension which is constant over an arc or sector which they define. The hinged connection of each full tooth 50*a* may define a portion of a circle.

The partial teeth 50*b*, 50*c* may have a radial height dimension that varies across their width. The height of the partial teeth 50*b*, 50*c*, the distance between the hinged connection to the main panel 12 and the opposing free edge defined by the aperture A2 may reduce as towards a recess C1, C2, C3 or tab 54.

The second article retention structures RT2 comprise discrete groups of teeth 50*a*, 50*b*, 50*c*, defined between a pair of recess C1, C2, C3 or between one of the recesses C1, C2, C3 and the tab 44. Each group of teeth 50*a*, 50*b*, 50*c* may comprise one full tooth 50*a* and a pair of partial teeth 50*b*, 50*c*. A partial tooth 50*b*, 50*c* may be disposed on opposite sides of the full tooth 50*a* and separated therefrom by a radial cut line 51. The second article retention structures RT2 may comprise at least one, two or more discrete groups of at least two, three, or more teeth 50*a*, 50*b*, 50*c*.

Each group of teeth 50*a*, 50*b*, 50*c* is hinged to the main panel 12 by a hinged connection the hinged connection is non-circular in shape, and may be defined by a portion of a squircle, truncated circle, flattened circle or rounded square. The shape may be or approximate a superellipse or hyperellipse.

The fold line 13 hinging the first end panel 14 to the main panel 12 is non-linear and may be curvilinear or arcuate. The fold line 13 hinging the first end panel 14 to the main panel 12 extends substantially between a pair of adjacently disposed first article retention structures RT1. The fold line 13 defines a convex hinged portion when viewed from an external viewpoint.

The fold line 15 hinging the second end panel 16 to the main panel 12 is non-linear and may be curvilinear or arcuate. The fold line 15 hinging the second end panel 16 to the main panel 12 extends substantially between a pair of adjacently disposed first article retention structures RT1. The fold line 15 defines a convex hinged portion when viewed from an external viewpoint.

The fold line 17 hinging the first side panel 18 to the main panel 12 is non-linear and may be curvilinear or arcuate. The fold line 17 hinging the first side panel 18 to the main panel 12 comprises plurality of curvilinear portions extending substantially between pairs of adjacently disposed article retention structures RT1, RT2. The fold line 17 defines a plurality of convex hinged portions when viewed from an external viewpoint.

The fold line 19 hinging the second side panel 20 to the main panel 12 is non-linear and may be curvilinear or arcuate. The fold line 19 hinging the second side panel 20 to the main panel 12 comprises plurality of curvilinear portions extending substantially between pairs of adjacently disposed article retention structures RT1, RT2. The fold line 19 defines a plurality of convex hinged portions when viewed from an external viewpoint.

Each curvilinear hinged portion extends substantially between a pair of tabs 42, 44.

Each curved fold line 13, 15, 17, 19 curves towards and terminates at, or in close proximity to, a curvilinear hinged connection between a group of teeth 40*a*, 40*b*. 40*c*; 50*a*, 50*b*, 50*c*.

Each curved fold line 13, 15, 17, 19 and/or curvilinear hinged connection between a group of teeth 40*a*, 40*b*, 40*c*; 50*a*, 50*b*, 50*c* terminates at, or in close proximity to, an end of a cut line defining a tab 42, 44.

In the embodiment illustrated in FIG. 1, the fold lines 13, 15, 17, 19 are defined by a plurality of spaced apart cut lines. The curvilinear hinged connection between groups of teeth 40*a*, 40*b*, 40*c*; 50*a*, 50*b*, 50*c* and the main panel 12 is defined by a plurality of spaced apart circumferential cut lines 43, 45, 53, 55. A notional extension of the endmost or terminal cutline defining the fold lines 13, 15, 17, 19 intersects or converges with a notional extension of the endmost or terminal cutline defining the curvilinear hinged connection between groups of teeth 40*a*, 40*b*, 40*c*; 50*a*, 50*b*, 50*c* and the main panel 12; in the illustrated embodiment, this is provided by one of the second circumferential cutlines 45, 55.

Each curved fold line 13, 15, 17, 19 converges with a respective curvilinear hinged connection between a group of teeth 40*a*, 40*b*, 40*c*; 50*a*, 50*b*, 50*c* at, or in close proximity to, a tab 42, 44, and may converge at an end of a cut line defining said tab 42, 44.

This may provide the benefit of directing load forces or stresses onto the side wall of the article B so as to increase the structural integrity or rigidity of the carrier 90; and may be particularly advantageous for impact forces directed at ends or sides of the carrier 90.

The curved fold lines 13, 15, 17, 19 may create tension, or a bias, in the side or end walls 14, 16, 18, 20. This may increase the side or end walls 14, 16, 18, 20 resistance to impacts.

The curved fold lines 13, 15, 17, 19 may create tension or a bias in the side or end walls 14, 16, 18, 20 which may have the effect of creating an over-centre or toggle mechanism creating bi-stability—two stable states or positions, a folded stable position and an unfolded stable position. This may facilitate retention of the side or end walls 14, 16, 18, 20 in a folded condition relative to the main panel 12 either in addition to or alternative to the tabs 42, 44. In this way the requirement of adhesive or other such fastening means may be negated.

Fold lines 13, 15, 17, 19 are non-linear such that at least one end portion thereof is curved toward an adjacent annular fold line about one of the article retention structures RT1, RT2 where the annular fold line is defined by the plurality of circumferential cut lines 43, 45, 53, 55.

Fold lines 13, 15, 17, 19 are non-linear such that at least one end portion thereof is curved toward an adjacent engaging tooth 40*c*.

Fold lines 13, 15, 17, 19 are non-linear such that at least one end portion thereof is curved toward the adjacent article receiving opening or aperture A1, A2.

Fold lines 17, 19 are curved such a first distance d1 between a terminal end of the fold lines 17, 19 and a second notional line Y-Y oriented longitudinally of the blank 10 and passing through the centres of receiving apertures A1, A2 is less than a second distance d2 where second distance d2 is the maximum distance between the line Y-Y and the respective fold line 17, 19. It will be appreciated that the fold lines 13, 15 are similarly arranged with respect to a first notional line X-X oriented transversely of the blank 10 and passing through the centres of receiving apertures A1.

The first end panel 14 is hingedly connected to the main panel 12 at first and second ends by first and second sections of the hinged connection in the form of a pair of fold lines 13*a*, 13*b*. The pair of fold lines 13*a*, 13*b* are divergently arranged with respect to each other.

The first side panel 18 is hingedly connected to the main panel 12 at first and second ends by first and second sections of the hinged connection in the form of a pair of fold lines 17*a*, 17*b*. The pair of fold lines 17*a*, 17*b* are divergently arranged with respect to each other.

The first end of the first end panel 14 and the first end of the first side panel 18 are hinged about a first corner 12*a* of the main panel 12. The first section 13*a* of the fold line 13 and the first section 17*a* of the fold line 17 are convergently arranged with respect to each other and may be obliquely arranged. The first section 13*a* of the fold line 13 and the first section 17*a* of the fold line 17 define, at least in part, a substantially triangular corner portion of the main panel 12 adjacent to a first article retention structure RT1.

The second end panel 16 is hingedly connected to the main panel 12 at first and second ends by first and second sections of the hinged connection in the form of a pair of fold lines 15*a*, 15*b*. The pair of fold lines 15*a*, 15*b* are divergently arranged with respect to each other.

The second side panel 20 is hingedly connected to the main panel 12 at first and second ends by first and second sections of the hinged connection in the form of a pair of fold lines 19*a*, 19*b*. The pair of fold lines 97*a*, 19*b* are divergently arranged with respect to each other.

The main panel 12 comprises four corner regions 12*a*, 12*b*, 12*c*, 12*d*, each is defined, at least in part, by obliquely arranged fold line sections 13*a*, 17*a*; 13*b*, 19*a*; 15*a*, 17*b*; 15*b*, 19*b*.

The blank 10 may comprise a handle structure H. The handle structure comprises a handle or finger opening disposed on a longitudinal axis bisecting the main panel 12. The handle opening is provided between a group of four article retention structures RT1, RT2. The group of four article retention structures RT1, RT2 is provided medially of the main panel 12. The handle opening is disposed between a second row of intermediate article retention structures RT2 and a third row of intermediate article retention structures RT2. The handle opening is located at the centre of the second group of four article retention structures RT2.

The handle opening lies, at least in part, between a first column of article retention structures RT1. RT2 and a second column of article retention structures RT1, RT2.

The handle opening is defined by a plurality of tabs 60, 62. The handle opening comprises four tabs 60, 62. Each tab 60, 62 is hinged to the main panel 12 by a hinged connection in the form of a fold line. An arcuate or curvilinear cut line may be provided between each fold line to define a corner or vertex of the handle opening. The handle opening is substantially rhombus or diamond shaped, in other embodiments other shapes may be employed such as, but not limited to square. The handle opening comprises a pair of major tabs 60 and a pair of minor tabs 62.

The pair of major tabs 60 are separated from each other by a first cut line or severable line. The pair of minor tabs 62 are separated from each other by the first cut line or severable line.

The pair of major tabs 60 are separated from the pair of minor tabs 62 by a second cut line or severable line.

The first cut line is colinear with a notional line passing transversely though the centre of the group of four intermediate article retention structures RT2. The first cut line may be linear in shape and may extend between a first pair of opposed vertices of the handle opening.

The second cut line may be non-linear in shape and may extend between a second pair of opposed vertices of the handle opening. The second cut line intersects the first cutline, the second cut line comprises a "V" or "U" shaped medial portion; a vertex of the "V" or "U" shaped portion intersects the first cutline.

One of the pair of major tabs 60 is hinged to the main panel 12 by a first fold line. The other one of the pair of major tabs 60 is hinged to the main panel 12 by a second fold line. The first fold line is divergently arranged with respect to the second fold line.

One of the pair of minor tabs 62 is hinged to the main panel 12 by a third fold line. The other one of the pair of minor tabs 62 is hinged to the main panel 12 by a fourth fold line. The third fold line is divergently arranged with respect to the fourth fold line.

The first fold line is divergently arranged with respect to the third fold line. The second fold line is divergently arranged with respect to the fourth fold line.

Each of the pair of major tabs 60 may comprise a fold line extending thereacross. The fold line may be substantially parallel to the fold line hinging the respective one of the pair of major tabs 60 to the main panel 12. The fold line may extend between the first cut line or severable line and the second cut line or severable line. The fold lines across the pair of major tabs 60 may define a "V" shaped fold arranged in opposition to the V" or "U" shaped medial portion of the second cut line.

The blank 10 is assembled about a group of articles B. The main panel 12 of the blank 10 is applied to the group of articles B. The main panel 12 is lowered with respect to the articles B. Each of the retention structures RT1, RT2 receives one of the articles B.

The blank 10 is folded, about fold lines 13, 15, 17, 19, about the side and ends of the article group to bring the side and end panels into face-to-face relationship therewith.

The tabs 42, 44 are folded about side walls of a respective article B. The tabs 42, 44 remain substantially coplanar with the side or end panel 14, 16, 18, 20 from which they extend. An inner face of the tabs 43, 44 abut a side wall, rim or chime of the articles B.

FIG. 2 shows the assembled carrier 90, the tabs 42, 44 abut side walls of the articles B encouraging the side and end panels 14, 16, 18, 20 into a folded condition.

The corner regions 12*a*, 12*b*, 12*c*, 12*d* of the main panel 12 adopt a non-coplanar arrangement with the main panel 12. The corner regions 12*a*, 12*b*, 12*c*, 12*d* are inclined upwardly as they extend outwardly due to the convergent nature of the fold line pairs 13*a*/17*a*; 13*b*/19*a*; 15*a*/17*b*; 15*b*/19*b*. This may be beneficial to impart additional strength or rigidity to the carrier 90 and reduce the likelihood of deformation when the carrier 90 is wrapped in a sheet or film of material such as, but not limited to heat or shrink wrap.

In the assembled carrier 90, each of the curved fold lines 13, 15, 17, 19 couples or joins with the curvilinear hinged connection between an adjacent group of teeth 40*a*, 40*b*, 40*c*; 50*a*, 50*b*, 50*c* and the main panel 12. The curved fold lines 13, 15, 17, 19 and curvilinear hinged connection may define or form convergent folds or creases in the substrate forming the carrier 90. In other embodiments each of the curved fold lines 13, 15, 17, 19 may be coupled or joined to an adjacent curvilinear hinged connection by a third fold or crease. The curved fold lines 13, 15, 17, 19 and curvilinear hinged connection meet or join in a location disposed in close proximity to an article B.

In some embodiments, the curved fold lines 13, 15, 17, 19 have the effect of encouraging the side and/or end walls 14, 16, 18, 20 to bow outwardly—to be convex when viewed from an external vantage point—in regions between a pair of adjacent articles B.

In some embodiments, the curved fold lines 13, 15, 17, 19 have the effect of encouraging the main panel 12 to bow downwardly—to be concave when viewed from an external vantage point above the main panel 112—in regions between a pair of adjacent articles B. In such embodiments, the side and/or end walls 14, 16, 18, 20 may be substantially planar.

Referring now to FIGS. 3 to 10, there are shown additional embodiments of the present disclosure. In the second, third, fourth and fifth illustrated embodiments like numerals have, where possible, been used to denote like parts, albeit with the addition of the prefix "100", "200", "300", "400", "500" to indicate that these features belong to the second, third, fourth, fifth, and sixth embodiment respectively. The additional embodiments share many common features with the first embodiment and therefore only the differences from the embodiment illustrated in FIGS. 1 and 2 will be described in detail.

Figure 3:
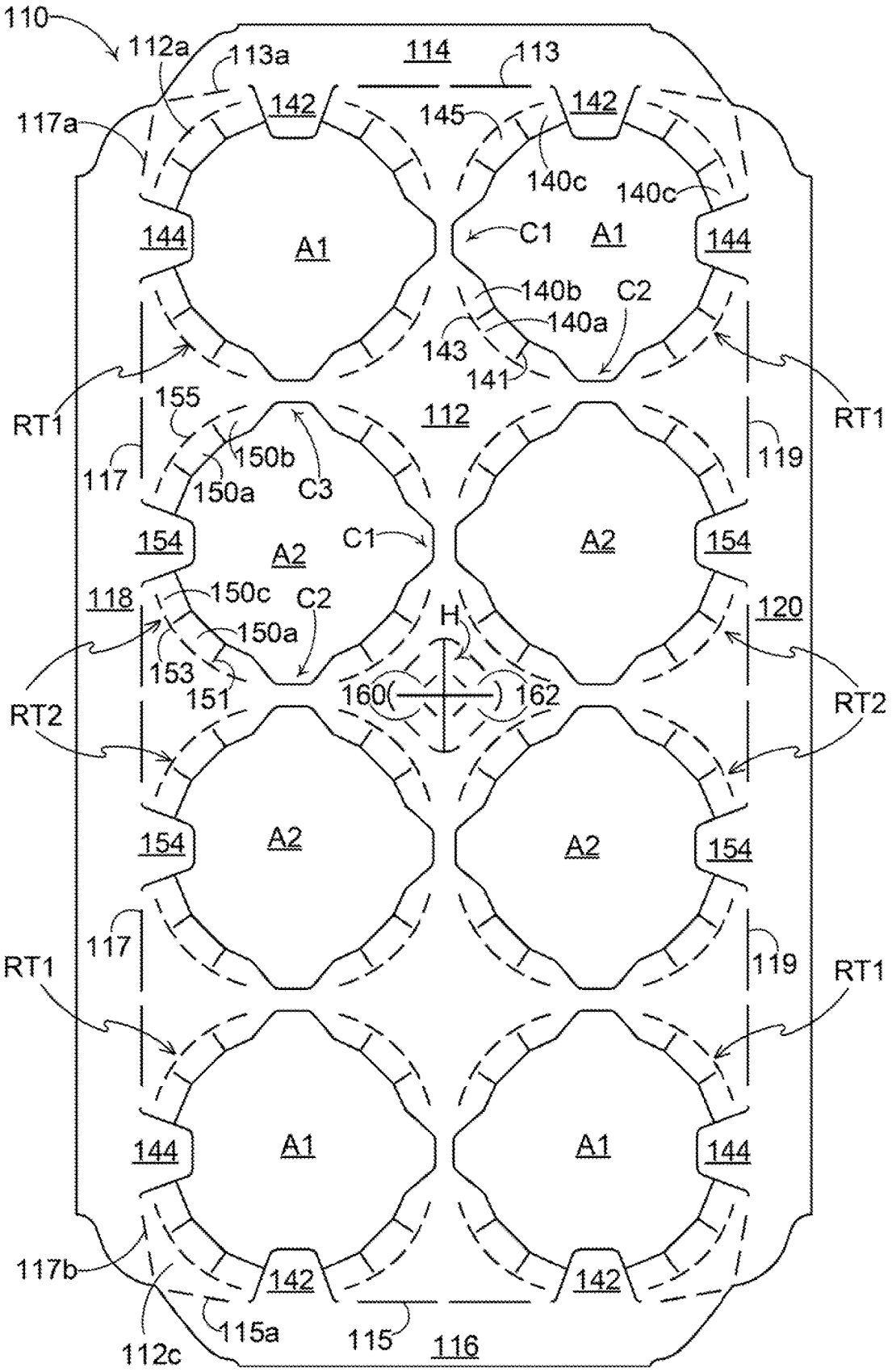
FIG. 3 is a plan view from above of a blank for forming a carrier according to a second embodiment.
Figure 4:
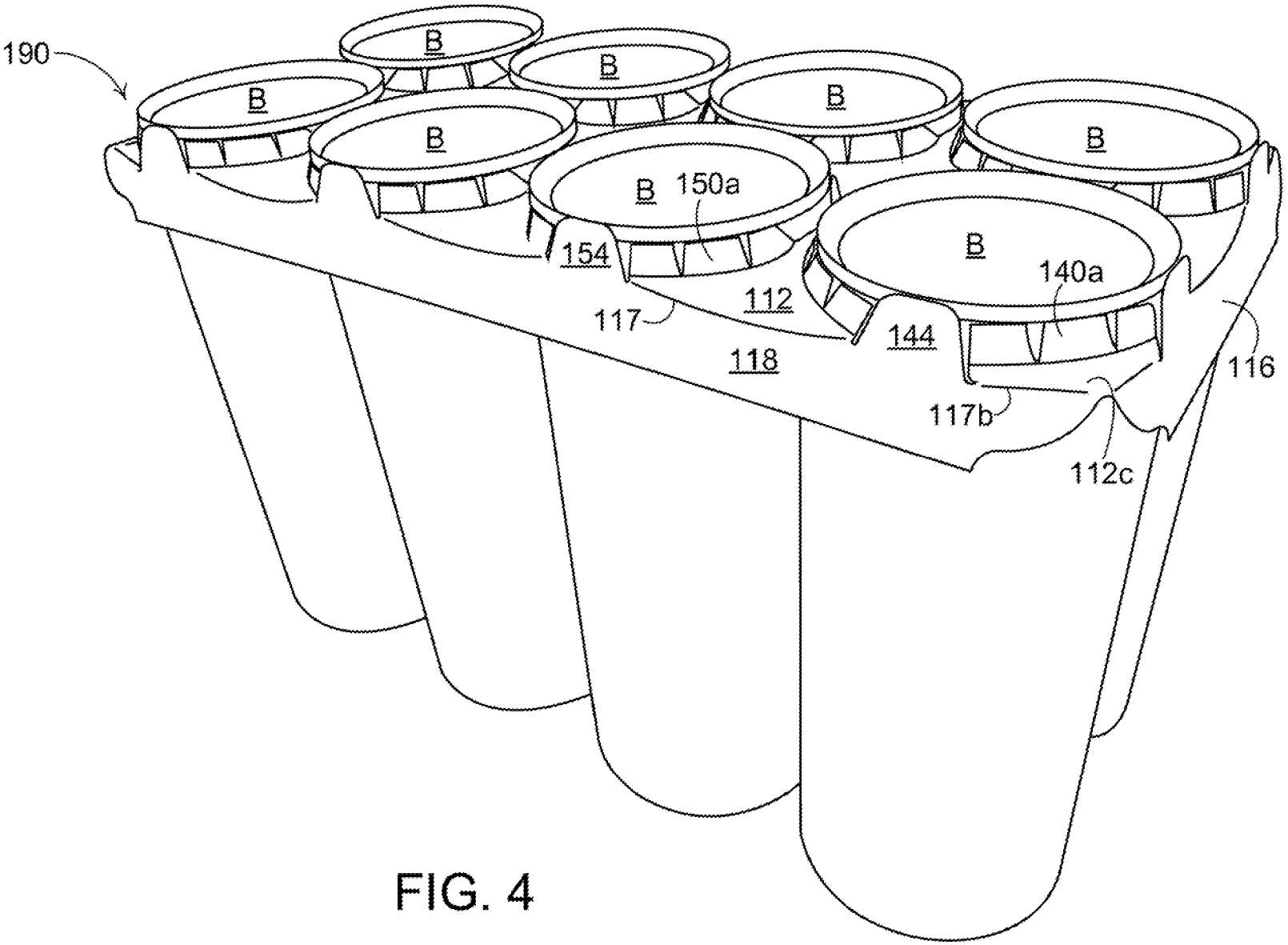
FIG. 4 is a perspective view from above of a carrier formed from the blank of FIG. 3.

FIG. 3 shows a blank 110 according to a second embodiment, the blank 110 comprises a main or engaging panel 112.

The blank 110 includes a first end panel 114 hingedly connected to a first end of the main panel 112 by a hinged connection in the form of a fold line 113. The fold line 113 is linear. The blank 110 includes a second end panel 116 hingedly connected to a second side of the main panel 112 by a hinged connection in the form of a fold line 115. The fold line 115 is linear.

The blank 110 includes a first side panel 118 hingedly connected to a first side of the main panel 112 by a hinged connection in the form of a fold line 117. The fold line 117 is linear. The blank 110 includes a second side panel 120 hingedly connected to a second side of the main panel 112 by a hinged connection in the form of a fold line 119. The fold line 119 is linear.

The main panel 112 includes at least one article retention structure RT1, RT2. In the illustrated embodiment, the main panel 112 comprises a plurality of article retention structures RT1, RT2 specifically eight article retention structures RT1, RT2 arranged in 4×2 matrix or array. The main panel 112 comprises two columns of article retention structures RT1, RT2, each column comprises four article retention structures RT1, RT2. The main panel 112 comprises four rows of article retention structures RT1, RT2, each row comprises two article retention structures RT1, RT2. Each of the article retention structures RT1, RT2 may comprise an aperture A1, A2.

The blank 110 comprises four first article retention structures RT1 which are substantially similar in construction to the first article retention structures RT1 of the first illustrated embodiment, albeit the first article retention structures RT1 comprise first and second abutment tabs 142, 144 which are symmetric in shape. The tabs 142, 144 are defined, at least in part, by a cut line. The cut line is substantially 'U' shaped. The cut line is symmetric. The cut line comprises a base portion defining a portion of the aperture A1 and a pair of leg portions extending therefrom. Each of the leg portion may terminate in a 'J' or 'C' shaped cut. Ends of the cutline terminate at or one the hinged connection between the main panel 112 and a respective one of the side or end panels 114, 116, 118, 120.

The blank 110 comprises four second article retention structures RT2 which are substantially similar in construction to the second article retention structures RT2 of the first illustrated embodiment. The tab 154 is symmetric in shape. The tab 154 is defined, at least in part, by a cut line. The cut line is substantially 'U' shaped. The cut line is symmetric. The cut line comprises a base portion defining a portion of the aperture A2 and a pair of leg portions extending therefrom. Each of the leg portion terminates in a 'J' or 'C' shaped cut.

The blank 110 comprises a handle structure H having a handle or finger opening disposed on a longitudinal axis bisecting the main panel 112.

The handle opening is provided between a group of four article retention structures RT1, RT2. The group of four article retention structures RT1, RT2 is provided medially of the main panel 112. The handle opening is disposed between a second row of intermediate article retention structures RT2 and a third row of intermediate article retention structures RT2. The handle opening is located at the centre of the second group of four article retention structures RT2.

The handle opening is defined by a plurality of tabs 160, 162. The handle opening comprises four tabs 160, 162. Each tab 160, 162 is hinged to the main panel 112 by a hinged connection in the form of a fold line. An arcuate or curvilinear cut line may be provided between each fold line to define a corner or vertex of the handle opening. The handle opening is substantially rhombus or diamond shaped, in other embodiments other shapes may be employed such as, but not limited to square.

The tabs 160, 162 are separated from each other by cutlines, a first longitudinal cut line and a second transverse cut line, each of which his linear. The cut lines extend between pairs of opposed vertices of the handle opening.

Each of the tabs 160, 162 may comprise a fold line extending thereacross. The fold line may be substantially parallel to a hinged connection hinging the respective one of the tabs 160, 162 to the main panel 112. The fold line may extend between the first longitudinal cut line and a second transverse cut line. The fold lines together may define a square or diamond shape.

Figure 5:
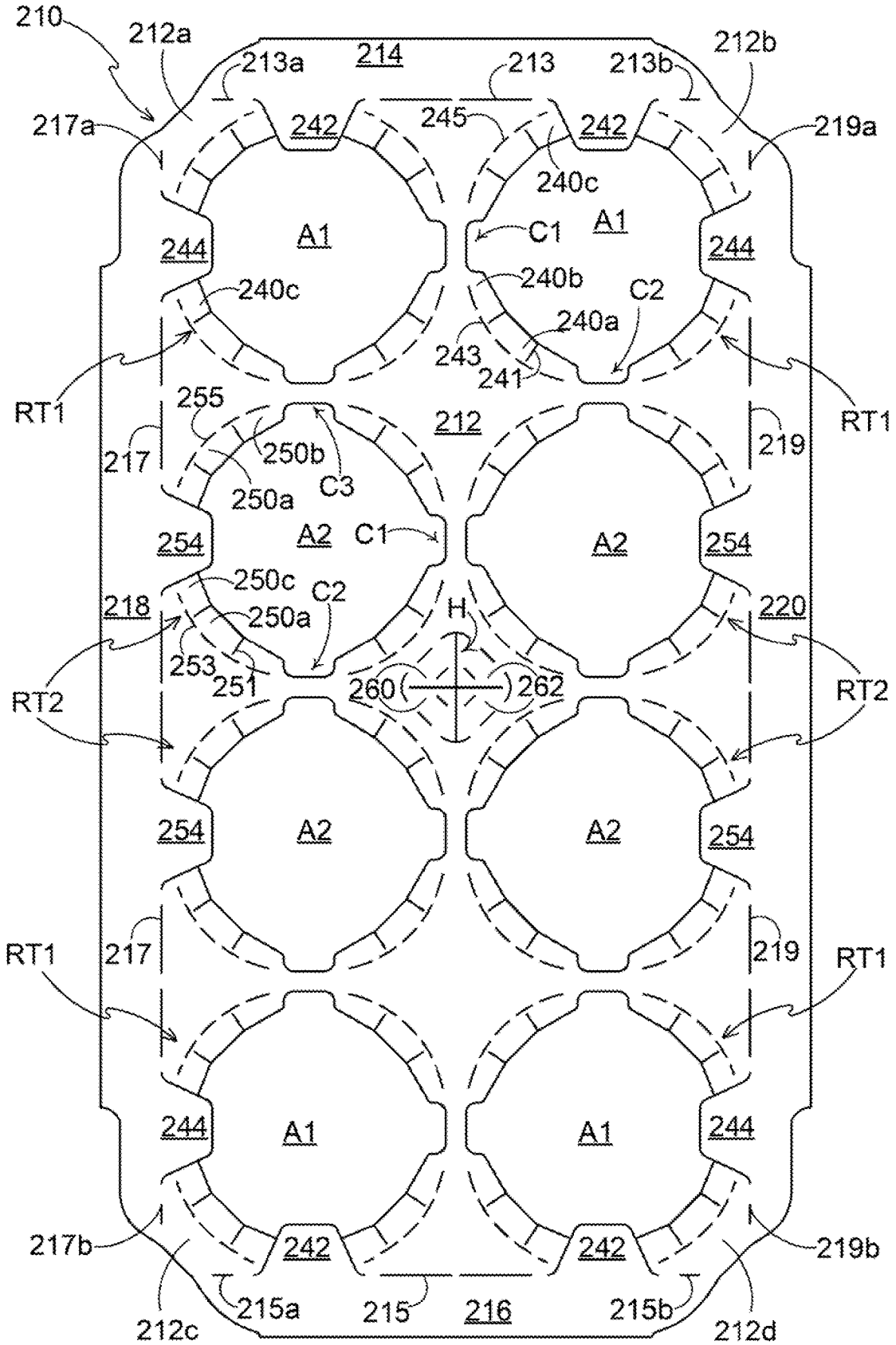
FIG. 5 is a plan view from above of a blank for forming a carrier according to a third embodiment.

FIG. 5 shows a blank 210 according to a third embodiment, the blank 210 comprises a main or engaging panel 212.

The blank 210 includes a first end panel 214 hingedly connected to a first end of the main panel 212 by a hinged connection in the form of a fold line 213. The fold line 213 is linear. The blank 210 includes a second end panel 216 hingedly connected to a second side of the main panel 212 by a hinged connection in the form of a fold line 215. The fold line 215 is linear.

The blank 210 includes a first side panel 218 hingedly connected to a first side of the main panel 212 by a hinged connection in the form of a fold line 217. The fold line 217 is linear. The blank 210 includes a second side panel 220 hingedly connected to a second side of the main panel 212 by a hinged connection in the form of a fold line 219. The fold line 219 is linear.

The main panel 212 includes at least one article retention structure RT1, RT2. In the illustrated embodiment, the main panel 212 comprises a plurality of article retention structures RT1, RT2 specifically eight article retention structures RT1, RT2 arranged in 4×2 matrix or array. The main panel 212 comprises two columns of article retention structures RT1, RT2, each column comprises four article retention structures RT1, RT2.

The main panel 212 comprises four rows of article retention structures RT1, RT2, each row comprises two article retention structures RT1, RT2. Each of the article retention structures RT1, RT2 may comprise an aperture A1, A2.

The blank 210 comprises four first article retention structures RT1 which are substantially similar in construction to the first article retention structures RT1 of the second illustrated embodiment shown in FIG. 3.

The blank 210 comprises four second article retention structures RT2 which are substantially similar in construction to the second article retention structures RT2 of the second illustrated embodiment shown in FIG. 3.

The main panel 212 comprises four corner regions 212*a*, 212*b*, 212*c*, 212*d*, each is defined, at least in part, by divergently arranged pairs of fold lines 213*a*, 217*a*; 213*b*, 219*a*; 215*a*, 217*b*; 215*b*, 219*b*. Each pair of fold lines 213*a*, 217*a*; 213*b*, 219*a*; 215*a*, 217*b*; 215*b*, 219*b* comprises a first fold line 213*a*, 217*a*, 213*b*, 219*a*, 215*a*, 217*b*, 215*b*, 219*b* oriented substantially perpendicularly to a second fold line 213*a*, 217*a*, 213*b*, 219*a*, 215*a*, 217*b*, 215*b*, 219*b*.

Each of the fold lines 213*a*, 217*a*, 213*b*, 219*a*, 215*a*, 217*b*, 215*b*, 219*b* may be substantially colinear with a respective one of the fold lines 213, 215, 217, 219 hinging the side and end panels 214, 216, 218, 220 to the main panel 212.

The corner regions 212*a*, 212*b*, 212*c*, 212*d* may comprise a bevel, chamfered or filleted corner defining a free edge of the main panel 212—that is to say the free edge is not hinged to any other panel.

The blank 210 comprises a handle structure H substantially similar in construction to the handle structure H of the second illustrated embodiment shown in FIG. 3.

Figure 6:
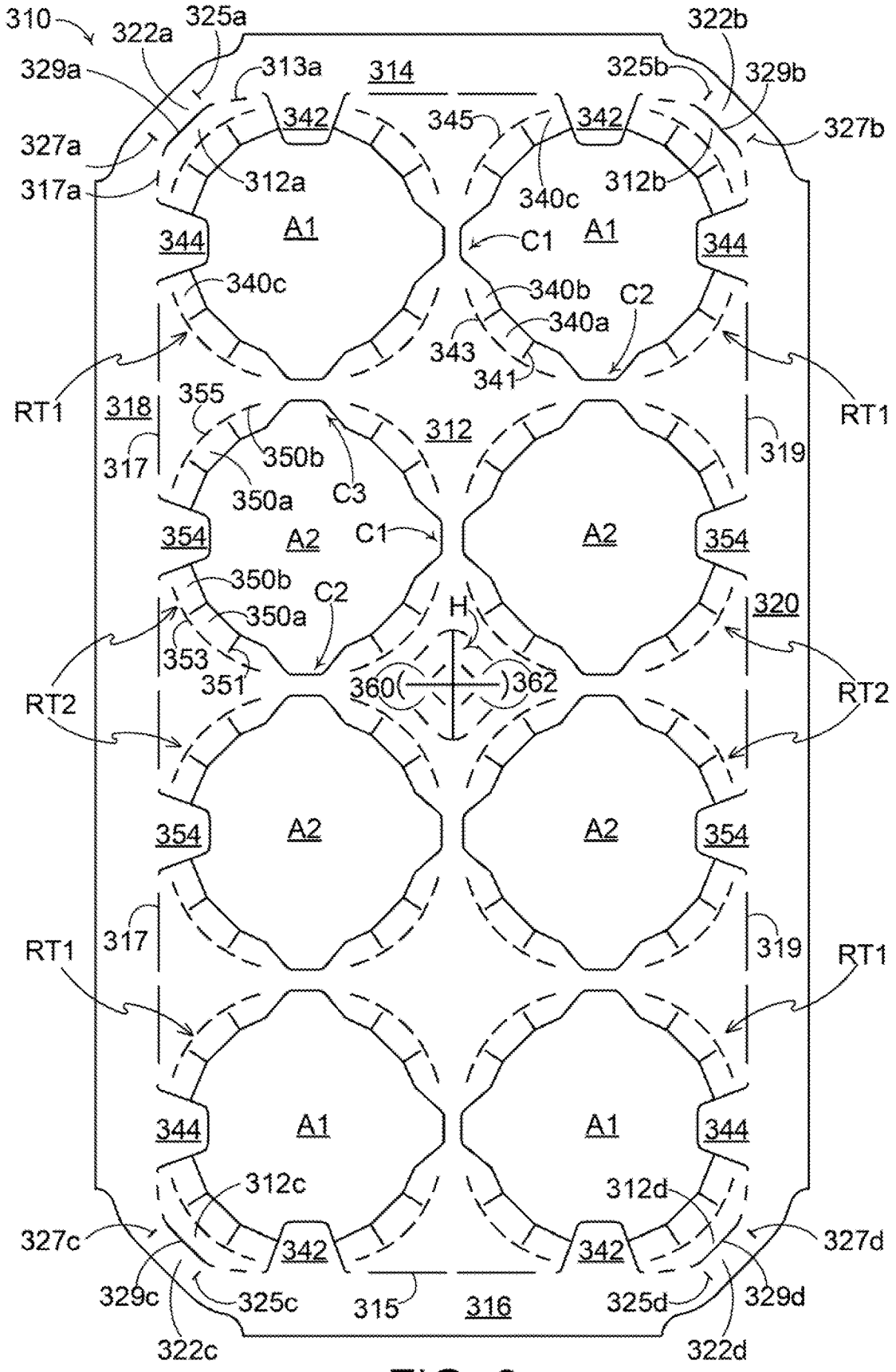
FIG. 6 is a plan view from above of a blank for forming a carrier according to a fourth embodiment.

FIG. 6 shows a blank 310 according to a fourth embodiment, the blank 310 comprises a main or engaging panel 312.

The blank 310 includes a first end panel 314 hingedly connected to a first end of the main panel 312 by a hinged connection in the form of a fold line 313. The fold line 313 is linear. The blank 310 includes a second end panel 316 hingedly connected to a second side of the main panel 312 by a hinged connection in the form of a fold line 315. The fold line 315 is linear.

The blank 310 includes a first side panel 318 hingedly connected to a first side of the main panel 312 by a hinged connection in the form of a fold line 317. The fold line 317 is linear. The blank 310 includes a second side panel 320 hingedly connected to a second side of the main panel 312 by a hinged connection in the form of a fold line 319. The fold line 319 is linear.

The blank 310 comprises four first article retention structures RT1 which are substantially similar in construction to the first article retention structures RT1 of the second illustrated embodiment shown in FIG. 3.

The blank 310 comprises four second article retention structures RT2 which are substantially similar in construction to the second article retention structures RT2 of the second illustrated embodiment shown in FIG. 3.

The main panel 312 comprises four corner regions 312*a*, 312*b*, 312*c*, 312*d*, each is defined, at least in part, by divergently arranged pairs of fold lines 313*a*, 317*a*; 313*b*, 319*a*; 315*a*, 317*b*; 315*b*, 319*b*. Each pair of fold lines 313*a*, 317*a*; 313*b*, 319*a*; 315*a*, 317*b*; 315*b*, 319*b* comprises a first fold line 313*a*, 317*a*, 313*b*, 319*a*, 315*a*, 317*b*, 315*b*, 319*b* oriented substantially perpendicularly to a second fold line 313*a*, 317*a*, 313*b*, 319*a*, 315*a*, 317*b*, 315*b*, 319*b*.

Each of the fold lines 313*a*, 317*a*, 313*b*, 319*a*, 315*a*, 317*b*, 315*b*, 319*b* may be substantially colinear with a respective one of the fold lines 313, 315, 317, 319 hinging the side and end panels 314, 316, 318, 220 to the main panel 312.

A first end of the first end panel 314 is coupled to a first end of the first side panel 318 by a first corner or bumper panel 322*a*. The first corner panel 322*a* may provide impact protection to the carrier 90 and/or adjacent article B. The first corner panel 322*a* is hingedly connected to the first end panel 314 by a hinged connection in the form of a fold line 325*a*. The first corner panel 322*a* is hingedly connected to the first side panel 318 by a hinged connection in the form of a fold line 327*a*.

A second end of the first end panel 314 is coupled to a first end of the second side panel 320 by a second corner or bumper panel 322*b*. The second corner panel 322*b* may provide impact protection to the carrier 90 and/or adjacent article B. The second corner panel 322*b* is hingedly connected to the first end panel 314 by a hinged connection in the form of a fold line 325*b*. The second corner panel 322*b* is hingedly connected to the second side panel 320 by a hinged connection in the form of a fold line 327*b*.

A first end of the second end panel 316 is coupled to a second end of the first side panel 318 by a third corner or bumper panel 322*c*. The third corner panel 322*c* may provide impact protection to the carrier 90 and/or adjacent article B. The third corner panel 322*c* is hingedly connected to the second end panel 316 by a hinged connection in the form of a fold line 325*c*. The third corner panel 322*c* is hingedly connected to the first side panel 318 by a hinged connection in the form of a fold line 327*c*.

A second end of the second end panel 316 is coupled to a second end of the second side panel 320 by a fourth corner or bumper panel 322*d*. The fourth corner panel 322*d* may provide impact protection to the carrier 90 and/or adjacent article B. The fourth corner panel 322*d* is hingedly connected to the second end panel 316 by a hinged connection in the form of a fold line 325*d*. The fourth corner panel 322*d* is hingedly connected to the second side panel 320 by a hinged connection in the form of a fold line 327*d*.

The corner regions 312*a*, 312*b*, 312*c*, 312*d* may be defined in part by a cut line 329*a*, 329*b*, 329*c*, 329*d*. The cut line 329*a*, 329*b*, 329*c*, 329*d* separates each corner region 312*a*, 312*b*, 312*c*, 312*d* from a respective one of the corner panels 322*a*, 322*b*, 322*c*, 322*d*.

The cut lines 329*a*, 329*b*, 329*c*, 329*d* define a bevel, chamfered or filleted corner defining a free edge portion of the main panel 312—that is to say the free edge portion is not hinged to any other panel.

Each cut line 329*a*, 329*b*, 329*c*, 329*d* extends between the fold lines of each pair of divergently arranged fold lines 313*a*/317*a*; 313*b*/319*a*; 315*a*/317*b*; 315*b*/319*b*.

Each cut line 329*a*, 329*b*, 329*c*, 329*d* may be non-linear in shape. The cut lines 329*a*, 329*b*, 329*c*, 329*d* may comprise curved end portions.

Each pair of divergently arranged fold lines 313*a*/317*a*; 313*b*/319*a*; 315*a*/317*b*; 315*b*/319*b* comprises a first fold line 313*a*, 317*a*, 313*b*, 319*a*, 315*a*, 317*b*, 315*b*, 319*b* oriented obliquely to a second fold line 313*a*, 317*a*, 313*b*, 319*a*, 315*a*, 317*b*, 315*b*, 319*b*.

In other embodiments, each first fold line 313*a*, 317*a*, 313*b*, 319*a*, 315*a*, 317*b*, 315*b*, 319*b* may be oriented perpendicularly to a second fold line 313*a*, 317*a*, 313*b*, 319*a*, 315*a*, 317*b*, 315*b*, 319*b*.

In the illustrated embodiment, each of the fold lines 313*a*, 317*a*, 313*b*, 319*a*, 315*a*, 317*b*, 315*b*, 319*b* is non-linearly arranged with respect to a respective one of the fold lines 313, 315, 317, 319 hinging the side and end panels 314, 316, 318, 220 to the main panel 312. In other embodiments, each of the fold lines 313*a*, 317*a*, 313*b*, 319*a*, 315*a*, 317*b*, 315*b*, 319*b* may be substantially collinear with a respective one of the fold lines 313, 315, 317, 319 hinging the side and end panels 314, 316, 318, 220 to the main panel 312.

Figure 7:
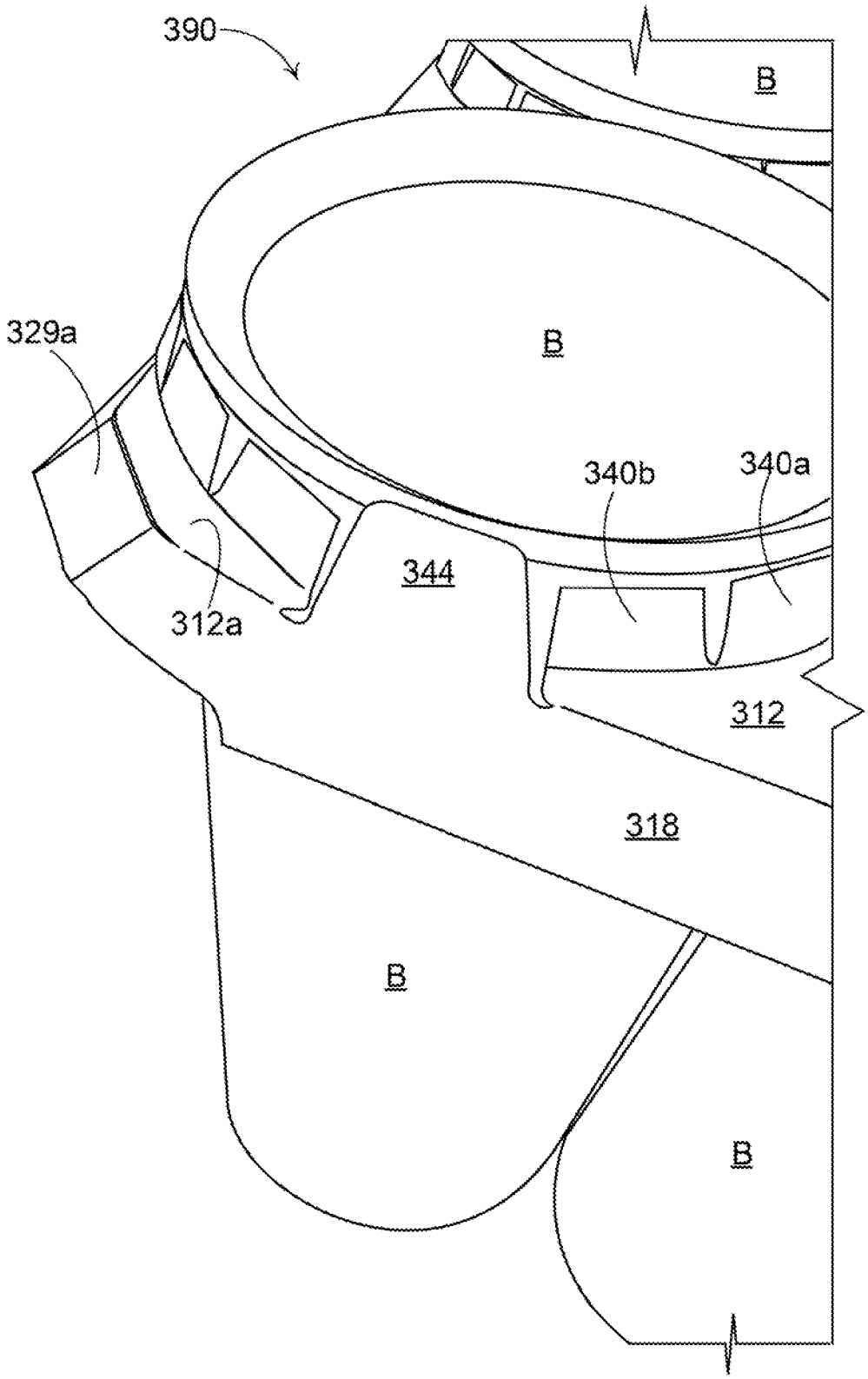
FIG. 7 is a perspective view from above of a portion of a carrier formed from the blank of FIG. 6.

FIG. 7 illustrates a corner portion of a carrier 390. FIG. 7 shows the first corner panel 322*a* adjacent to a first corner region 312*a* an inclined thereto.

FIG. 8 shows a blank 410 according to a fifth embodiment, the blank 410 comprises a main or engaging panel 412 forming part of a carrier 490 shown in FIG. 9.

The blank 410 includes a first end panel 414 hingedly connected to a first end of the main panel 412 by a hinged connection in the form of a fold line 413. The fold line 413 is linear. The blank 410 includes a second end panel 416 hingedly connected to a second side of the main panel 412 by a hinged connection in the form of a fold line 415. The fold line 415 is linear.

The blank 410 includes a first side panel 418 hingedly connected to a first side of the main panel 412 by a hinged connection in the form of a fold line 417. The fold line 417 is linear. The blank 410 includes a second side panel 420 hingedly connected to a second side of the main panel 412 by a hinged connection in the form of a fold line 419. The fold line 419 is linear.

The blank 410 comprises four first article retention structures RT1 which are substantially similar in construction to the first article retention structures RT1 of the first illustrated embodiment shown in FIG. 1 albeit the cutaways C1, C2 have been omitted and replaced with article engaging or supporting teeth 440. The abutment tabs 442, 444 have been shortened or reduced in height such that free edges thereof define part of a polygon with engaging edges of the engaging teeth 440.

The first article retention structures RT1 may each comprise sixteen tabs 440, 442, 444 and each tab 440, 442, 444 comprises a linear edge which defines a part of the article receiving aperture A1. The article receiving aperture A1 may be a polygon, in the illustrated embodiment, a hexadecagon.

The plurality of engaging teeth 440 are hinged to the main panel 412 by a fold line. The fold line may be defined by a plurality of cut lines 443, 445. The plurality of cut lines 443, 445 may define or approximate a circle.

The blank 410 comprises four second article retention structures RT2 which are substantially similar in construction to the first article retention structures RT1, albeit one of the abutment tabs has been omitted and replaced with an engaging tooth 440.

The blank 410 comprises a handle structure H substantially similar in construction to the handle structure H of the first illustrated embodiment shown in FIG. 1, albeit the structure is rotated though 90° such that the linear cutline extends longitudinally of the blank 410 and the nonlinear cut line extends transversely of the blank 410.

A plurality of handle structures is provided. The handle structure may comprise one, two or more handle or finger openings spaced apart from each other. The illustrated embodiment comprises three handle or finger openings.

The handle or finger openings are disposed on a longitudinal axis bisecting the engaging panel 412.

A first handle opening is provided between a first group of four article retention structures RT1, RT2. The first group of four article retention structures RT1, RT2 is provided adjacent a first end of the engaging panel 412. The first handle opening is disposed between a first row of endmost article retention structures RT1 and a second row of intermediate article retention structures RT2. The first handle opening is located at the centre of the first group of four article retention structures RT1, RT2.

A second handle opening is provided between a second group of four article retention structures RT2. The second group of four article retention structures RT2 is provided medially of the engaging panel 412. The second handle opening is disposed between the second row of intermediate article retention structures RT2 and a third row of intermediate article retention structures RT2. The second handle opening is located at the centre of the second group of four article retention structures RT2.

A third handle opening H is provided between a third group of four article retention structures RT1, RT2. The third group of four article retention structures RT1, RT2 is provided adjacent a second end of the engaging panel 412. The third handle opening H is disposed between the third row of intermediate article retention structures RT2 and a fourth row of endmost article retention structures RT1. The third handle opening H is located at the centre of the third group of four article retention structures RT1, RT2.

Figure 10:
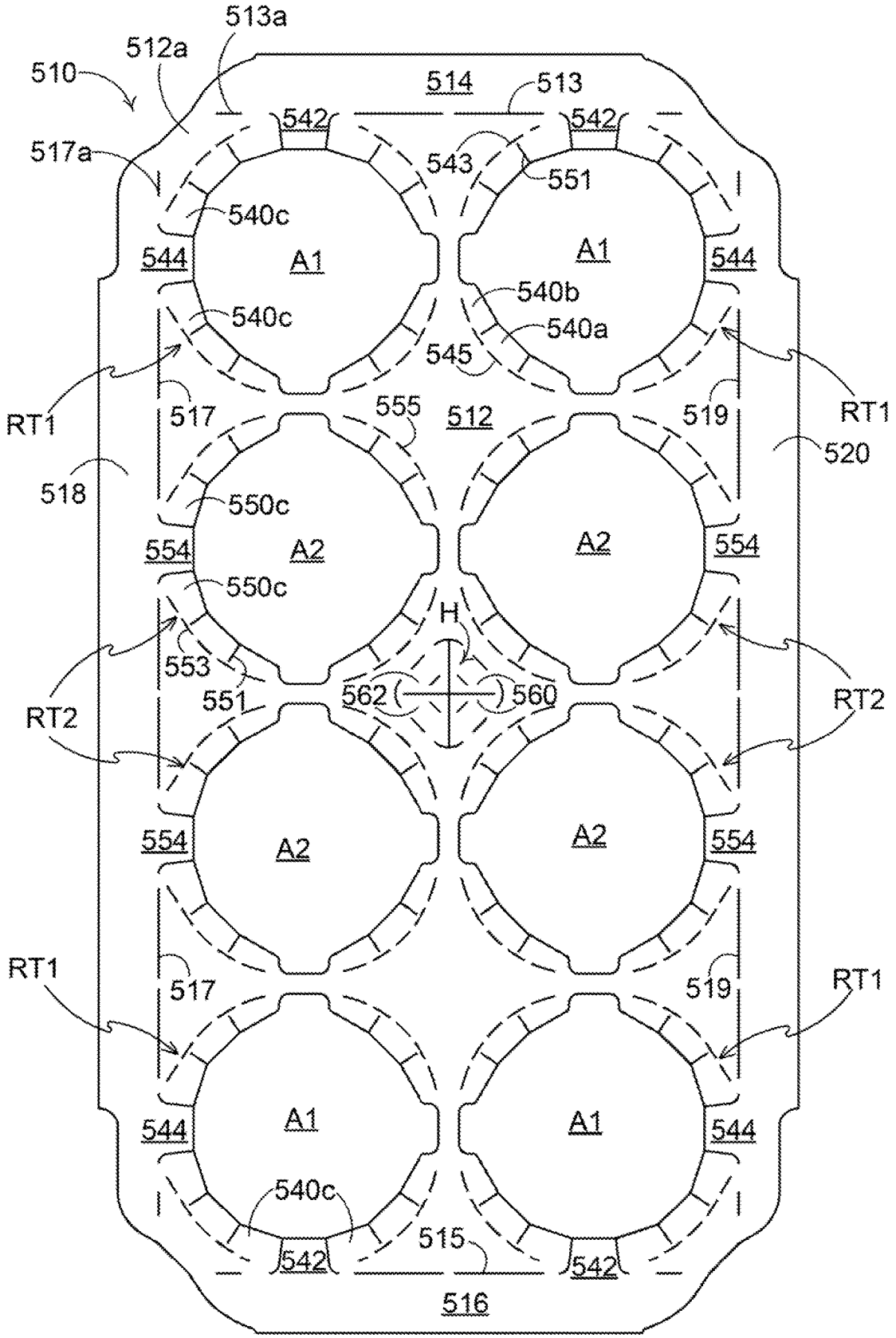
FIG. 10 is a plan view from above of a blank for forming a carrier according to a sixth embodiment.

FIG. 10 shows a blank 510 according to a sixth embodiment, the blank 510 comprises a main or engaging panel 512.

The blank 510 includes a first end panel 514 hingedly connected to a first end of the main panel 512 by a hinged connection in the form of a fold line 513. The fold line 513 is linear. The blank 510 includes a second end panel 516 hingedly connected to a second side of the main panel 512 by a hinged connection in the form of a fold line 515. The fold line 515 is linear.

The blank 510 includes a first side panel 518 hingedly connected to a first side of the main panel 512 by a hinged connection in the form of a fold line 517. The fold line 517 is linear. The blank 510 includes a second side panel 520 hingedly connected to a second side of the main panel 512 by a hinged connection in the form of a fold line 519. The fold line 519 is linear.

The blank 510 comprises a handle structure H substantially similar in construction to the handle structure H of the second illustrated embodiment shown in FIG. 3.

The blank 510 comprises four first article retention structures RT1 which are substantially similar in construction to the first article retention structures RT1 of the second illustrated embodiment shown in FIGS. 1 and 3 albeit the abutment tabs 542, 544 have been reduced in height such that a free edge of the abutment tabs 542, 544 extends between engaging edges of the partial teeth 540*c* disposed on either side thereof. The hinged connection between the partial teeth 540*c*, disposed on opposing sides the abutment tabs 542, 544 and the main panel 512 has been modified to intersect with the hinged connection between the side or end panels 514, 516, 518, 520 and the main panel 512, said hinged connections being defined, at least in part, by fold line 513, 515, 517, 519. The hinged edge of the partial teeth 540*c* is divergent with respect to the free or engaging edge of the partial teeth 540*c*.

The blank 510 comprises four second article retention structures RT2 which are substantially similar in construction to the second article retention structures RT2 of the second illustrated embodiment shown in FIGS. 1 and 3. In the embodiment of FIG. 10 the abutment tabs 554 have been reduced in height such that a free edge of the abutment tabs 554 extends between engaging edges of the partial teeth 550*c* disposed on either side thereof. The hinged connection between the partial teeth 550*c* disposed on opposing sides the abutment tabs 554 and the main panel 512 has been modified to intersect with the hinged connection between the side or end panels 514, 516, 518, 520 and the main panel 512, said hinged connections being defined, at least in part, by fold line 513, 515, 517, 519. The hinged edge of the partial teeth 550*c* is divergent with respect to the free or engaging edge of the partial teeth 550*c*.

In this way the first and second article retention structures RT1, RT2 define non-circular openings. The openings may be defined in part by a squircle and in part by a lobe extending therefrom. In other embodiments, the squircle portion may be replaced with a circular portion.

Referring now to FIGS. 11 to 16, there are shown additional embodiments of the present disclosure. In the seventh, eighth, and ninth illustrated embodiments like numerals have, where possible, been used to denote like parts, albeit with the addition of the prefix "600", "700"; "800" to indicate that these features belong to the seventh, eighth, and ninth embodiment respectively. The additional embodiments share many common features with the previous embodiments and therefore only the differences from the embodiments illustrated in FIGS. 1 to 10 will be described in detail.

Figure 11:
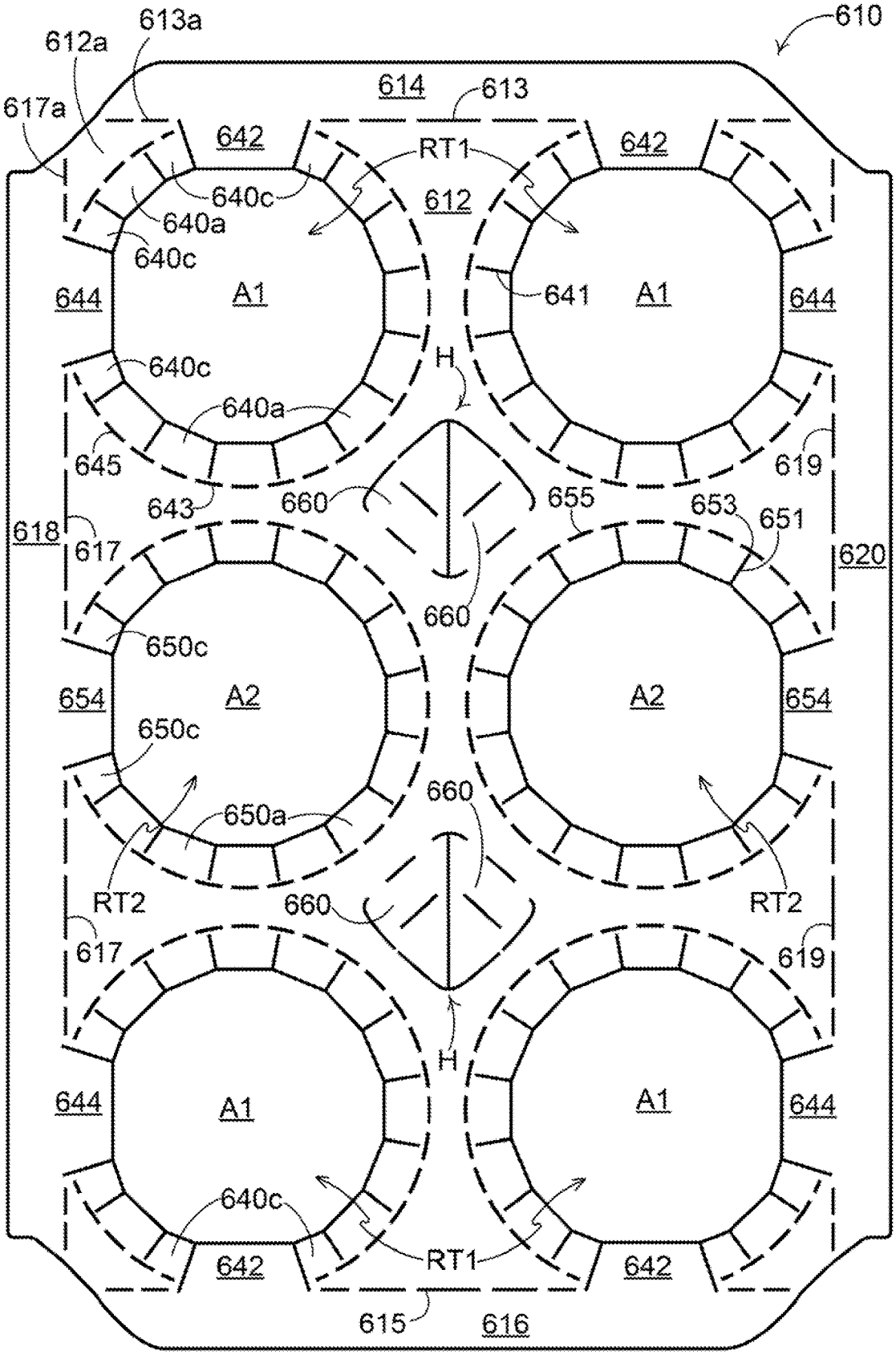
FIG. 11 is a plan view from above of a blank for forming a carrier according to a seventh embodiment.
Figure 12:
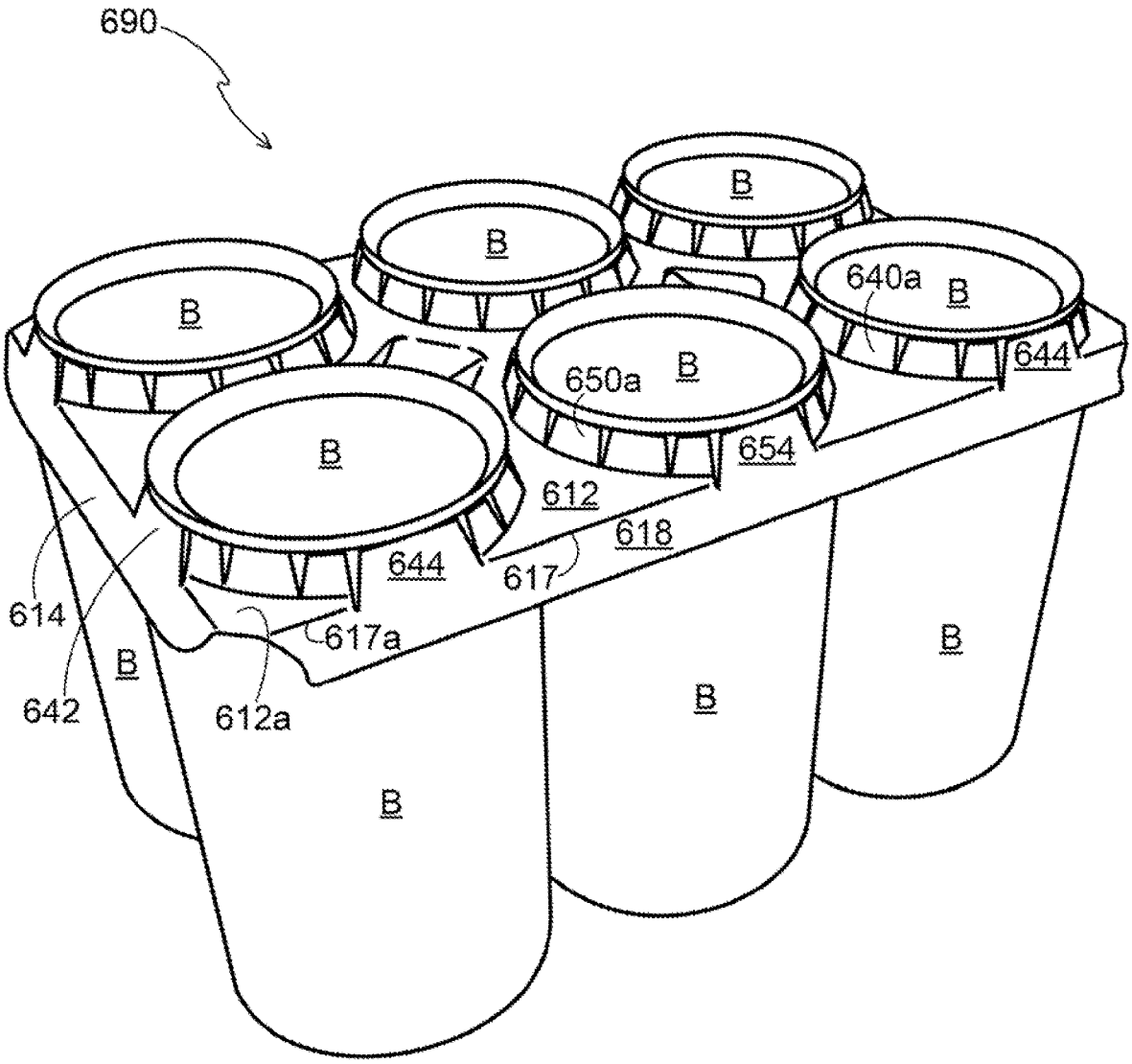
FIG. 12 is a perspective view from above of a carrier formed from the blank of FIG. 11.

FIG. 11 shows a blank 610 according to a seventh embodiment, the blank 610 comprises a main or engaging panel 612 forming part of a carrier 690 shown in FIG. 12.

The blank 610 includes a first end panel 614 hingedly connected to a first end of the main panel 612 by a hinged connection in the form of a fold line 613. The fold line 613 is linear. The blank 610 includes a second end panel 616 hingedly connected to a second side of the main panel 612 by a hinged connection in the form of a fold line 615. The fold line 615 is linear.

The blank 610 includes a first side panel 618 hingedly connected to a first side of the main panel 612 by a hinged connection in the form of a fold line 617. The fold line 617 is linear. The blank 610 includes a second side panel 620 hingedly connected to a second side of the main panel 612 by a hinged connection in the form of a fold line 619. The fold line 619 is linear.

The main panel 612 comprises four corner regions 612*a* each substantially the same in construction. The corner regions 612*a* will be described in further detail with reference to a first corner region 612*a*. The first corner region 612*a* is defined, at least in part, by a divergently arranged pair of fold lines 613*a*, 617*a*. The pair of fold lines 613*a*, 617*a* comprises a first fold line 613*a* oriented substantially perpendicularly to a second fold line 617*a*.

Each of the pair of fold lines 613*a*, 617*a* is substantially colinear with a respective one of the fold lines 613, 617 hinging the first side panel and first end panel 614, 618 to the main panel 612.

The first corner region 612*a* may comprise a bevel, chamfered or filleted corner defining a free edge of the main panel 612—that is to say the free edge is not hinged to any other panel.

End edges of the first and second side panels 618, 620 may be shaped to define an internal corner or a recess, each internal corner or recess may define a two or more divergently arranged registration or alignment edges. A lower or outer portion of the end edges of the first and second side panels 618, 620 may be shaped to define an external corner having generally square shape and forms part of an outer or lower free edge opposing a hinged edge.

End edges of the first and second end panels 614, 616 may be shaped to define an external corner the external corner may be rounded in shape and forms part of an outer or lower free edge opposing a hinged edge.

The blank 610 comprises a first flap 614, 616 hinged to the main panel 612 having rounded outer or lower corners and an adjacently disposed second flap 618, 620 hinged to the main panel 612 has generally square outer or lower corners.

The blank 610 comprises four first article retention structures RT1 which are substantially similar in construction to the first article retention structures RT1 of the illustrated embodiment shown in FIG. 8 albeit the abutment tabs 642, 644 have been widened so as to occupy a larger portion of the circumference of an article receiving opening defined in part by an aperture A1. A partial tab or tooth 640*c* is provided on each side of each abutment tab 642, 644. An abutment tab 642, 644 and the associated pair of partial tabs 640*c* occupy an angular width equivalent to three first teeth 640*a*, said angular width may be 67.5°. The abutment tabs 642, 644 may occupy approximately 39.5°, each partial tab 640*c* may occupy approximately 14°.

Each of the pair of radial cutlines 641*a* of the abutment tab 642, 644 extends to a fold line 613, 615, 617, 619 hinging a side or end panel 618, 620, 614, 616 to the main panel 612.

The abutment tab 642, 644 interrupts the respective one of the fold lines 613, 615, 617, 619 hinging the main panel 612 to the side or end panel 618, 620, 614, 616 to, or from, which it extends, that is to say the abutment tab 642, 644 is integral with one of the side or end panels 618, 620, 614, 616.

The fold lines 613, 615, 617, 619 hinging the side or end panel 618, 620, 614, 616 to the main panel 612 may comprise a plurality of spaced apart cutlines arranged collinearly with each other. The plurality of spaced apart cutlines may comprise two, three or more discrete cutlines. The plurality of spaced apart cutlines may comprise two, three or more discrete cutlines each having a different length.

Each of the first article retention structures RT1 may comprise sixteen tabs 640*a*, 640*c*, 642, 644. Each tab 640*a*, 640*c*, 642, 644 comprises a linear edge which defines a part of the article receiving aperture A1. The article receiving aperture A1 may be an irregular polygon, in the illustrated embodiment, a hexadecagon.

The plurality of engaging teeth 640*a*, 640*c* are hinged to the main panel 612 by a fold line. The fold line may be defined by a plurality of cut lines 643, 645. The plurality of cut lines 643, 645 may define or approximate a circle.

The hinged connection between the plurality of engaging teeth 640*a*, 640*c* and the main panel 612 is spaced apart from respective ones of the fold lines 613, 615, 617, 619 hinging the side or end panels 618, 620, 614, 616 to the main panel 612. In this way the circumferential fold defining the plurality of engaging teeth 640*a*, 640*c* is spaced apart from a linear fold hinging a side or end panel 618, 620, 614, 616 to the main panel 612.

The abutment tabs 642, 644 are defined by a pair of radial cutlines 641*a*, the radial cutlines 641*a* of the abutment tabs 642, 644 are longer in length than at least one of the radial cuttines 641 defining the first teeth 640*a*. The pair of radial cutlines 641*a* extend beyond a perimeter of the engaging teeth 640*a*, 640*c*, that is to say beyond the circumferential fold defining outer edges of the plurality of engaging teeth 640*a*, 640*c*, the circumferential fold being defined by the plurality of cut lines 643, 645.

The first article retention structures RT1 each comprise two abutment tabs 642, 644 and three engaging teeth 640*a*, 640*c* disposed therebetween, the three engaging teeth 640*a*, 640*c* are each smaller or narrower in width, angular width, than either of the two abutment tabs 642, 644. The three engaging teeth 640*a*, 640*c* are disposed adjacent to, and/or define, a corner region 612*a* of the main panel 612.

The blank 610 comprises two second article retention structures RT2 which are substantially similar in construction to the first article retention structures RT1, albeit one of the abutment tabs 642 and the associated pair of partial tabs 640*c* have been omitted and replaced with three first engaging teeth 640*a*.

The first and second article retention structures RT1, RT2 each comprise three differently sized tabs or teeth 642, 644, 640*a*, 640*c*, the tabs or teeth 642, 644, 640*a*, 640*c* defining, or occupying, three different angular widths. The three differently sized tabs or teeth 642, 644, 640*a*, 640*c* are disposed adjacent to one another.

The blank 610 comprises a handle structure H. The handle structure H may comprise at least one handle or finger opening. The illustrated embodiment comprises two handle or finger openings spaced apart from each other.

The handle or finger openings are disposed on a longitudinal axis bisecting the main or engaging panel 612.

A first handle opening is provided between a first group of four article retention structures RT1, RT2. The first group of four article retention structures RT1, RT2 is provided adjacent a first end of the engaging panel 612. The first handle opening is disposed between a first row of endmost article retention structures RT1 and a second row of intermediate article retention structures RT2. The first handle opening is located at the centre of the first group of four article retention structures RT1, RT2.

A second handle opening is provided between a second group of four article retention structures RT1, RT2. The second group of four article retention structures RT1, RT2 is provided medially of the engaging panel 612. The second handle opening is disposed between the second row of intermediate article retention structures RT2 and a third row of endmost article retention structures RT1. The second handle opening is located at the centre of the second group of four article retention structures RT1, RT2.

Each of the first and second handle openings is defined, at least in part, by a pair of handle tabs 660 struck from the engaging panel 612 and hingedly connected thereto by a hinged connection in the form of a fold line. The first and second handle opening may be generally square, kite or diamond shaped. Each of the pair of handle tabs 660 may be generally triangular. A first one of the pair of handle tabs 660 is separated from a second one of the pair of handle tabs 660 by a cut line or severable line. Each of the pair of handle tabs 660 may comprise a fold line arranged substantially parallel with its hinged connection to the engaging panel 612.

Figure 13:
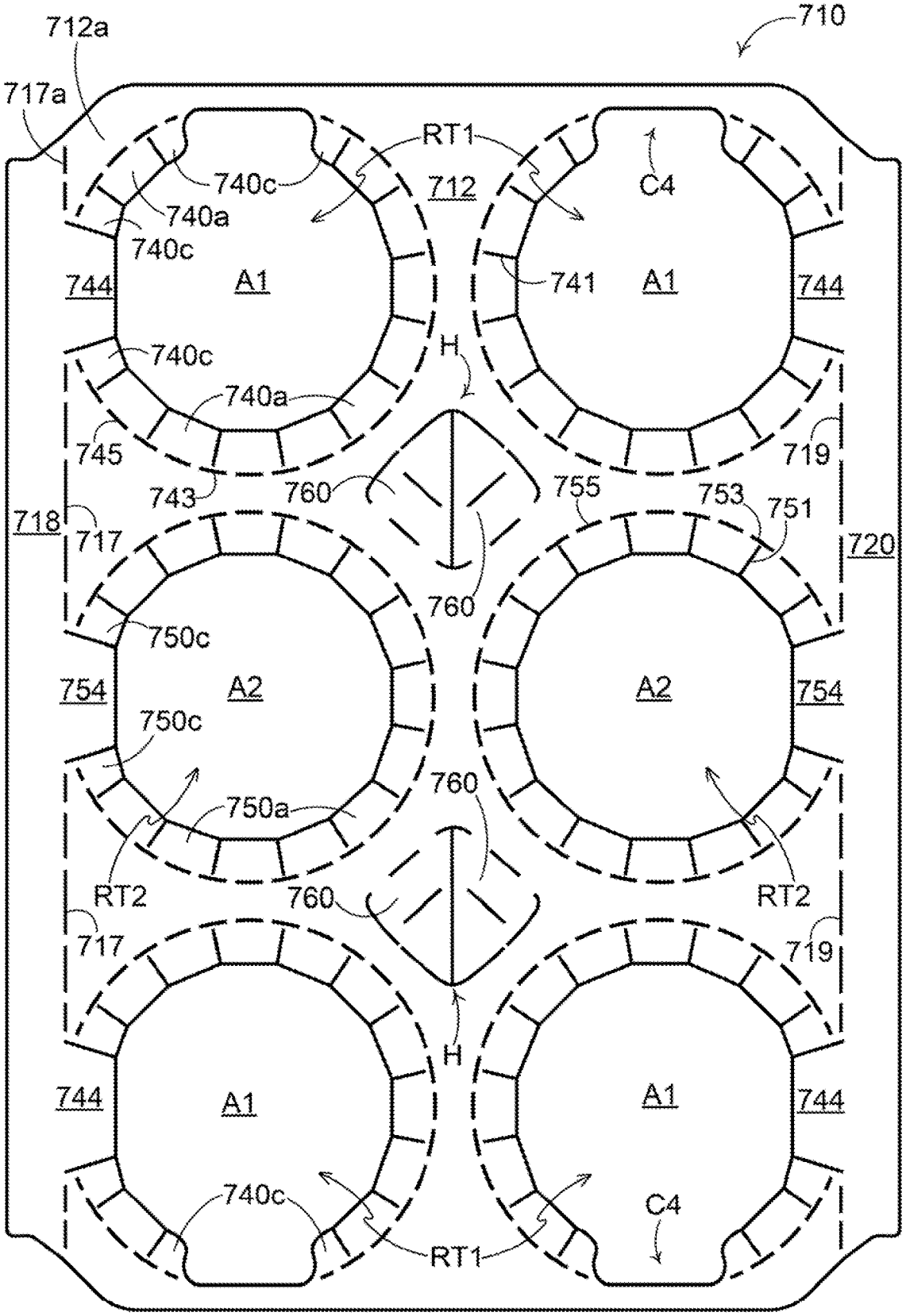
FIG. 13 is a plan view from above of a blank for forming a carrier according to an eighth embodiment.
Figure 14:
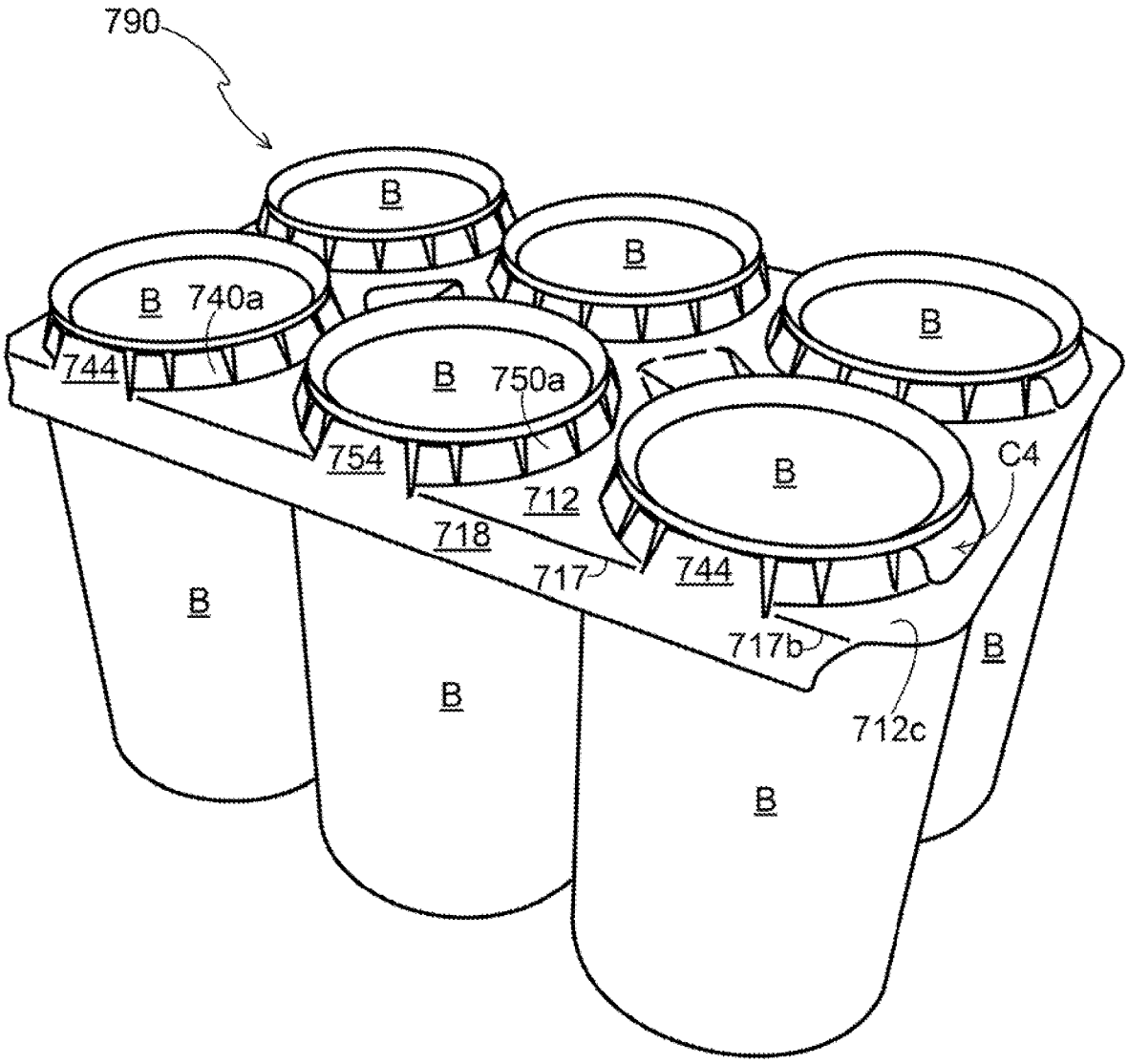
FIG. 14 is a perspective view from above of a carrier formed from the blank of FIG. 13.

FIG. 13 shows a blank 710 according to an eighth embodiment, the blank 710 comprises a main or engaging panel 712 forming part of a carrier 790 shown in FIG. 14.

The blank 710 is substantially similar in construction to the blank 610 of the seventh illustrated embodiment shown in FIG. 11, albeit the first and second end panels 614, 616 have been omitted. The blank 710 includes a first side panel 718 hingedly connected to a first side of the main panel 712 by a hinged connection in the form of a fold line 717.

The fold line 717 is linear. The blank 710 includes a second side panel 720 hingedly connected to a second side of the main panel 712 by a hinged connection in the form of a fold line 719. The fold line 719 is linear.

The blank 710 comprises four first article retention structures RT1 which are substantially similar in construction to the first article retention structures RT1 of the illustrated embodiment shown in FIG. 11 albeit the abutment tabs 642 that extend from the first and second end panels 614, 616 have been omitted and replaced with a cutaway in the form of a recess C4. The recess C4 is flanked by a pair of partial tabs 740*c*, a partial tab 740*c* being disposed on each side of the recess C4.

Figure 15:
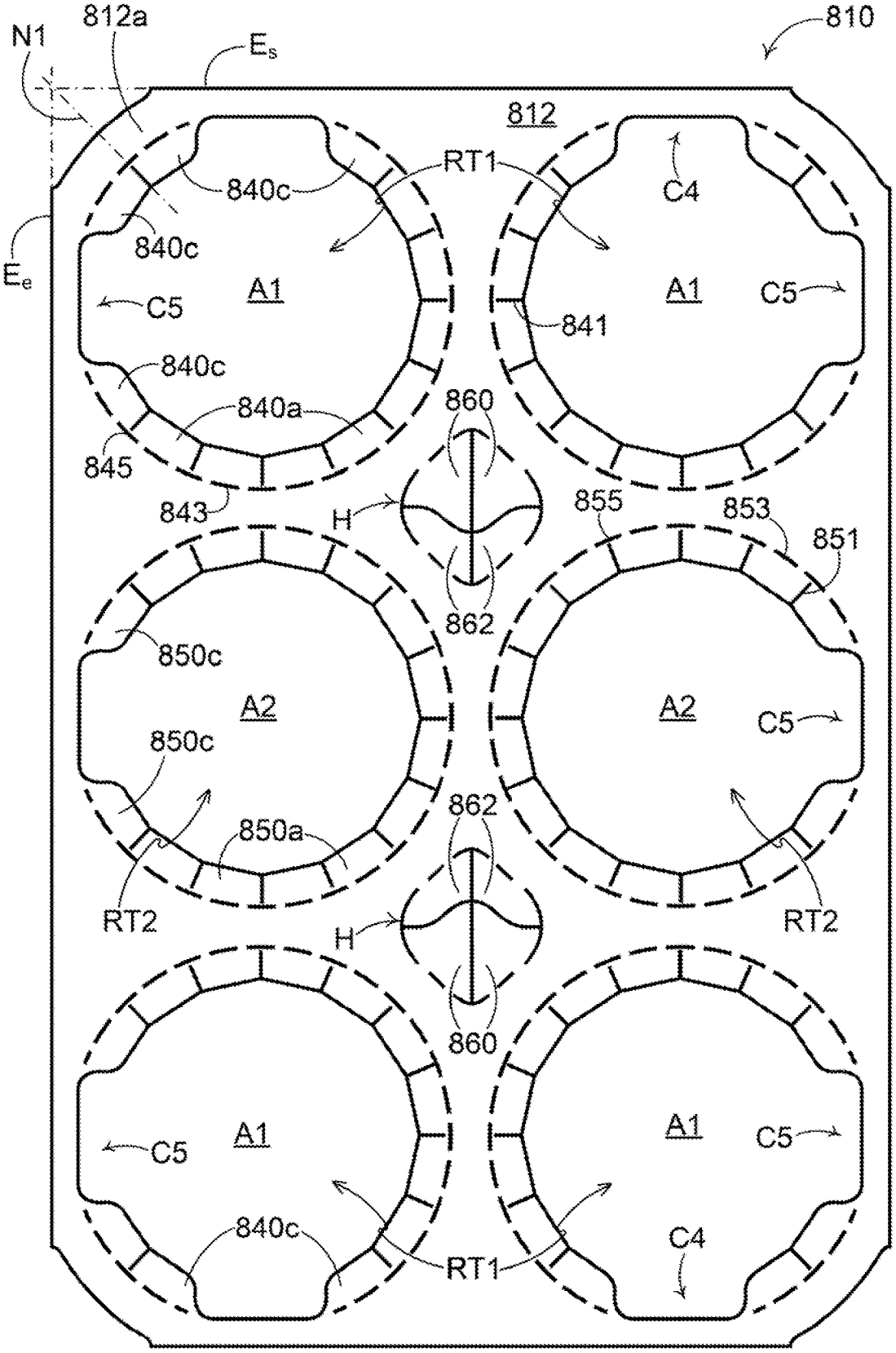
FIG. 15 is a plan view from above of a blank for forming a carrier according to a ninth embodiment.
Figure 16:
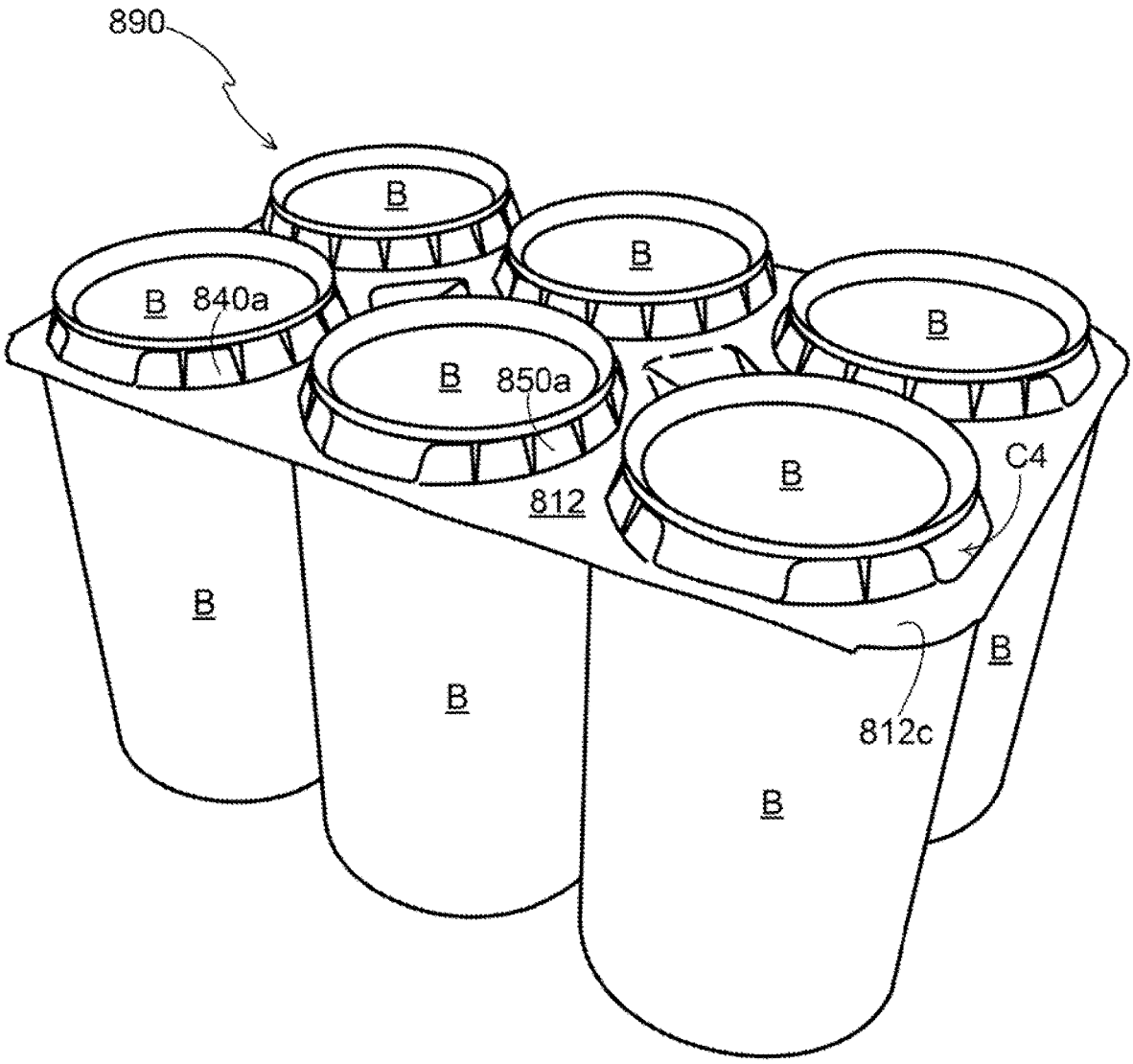
FIG. 16 is a perspective view from above of a carrier formed from the blank of FIG. 1.

FIG. 15 shows a blank 810 according to a ninth embodiment, the blank 810 comprises a main or engaging panel 812 forming part of a carrier 890 shown in FIG. 16.

The blank 810 is substantially similar in construction to the blanks 610, 710 of the seventh and eighth illustrated embodiments shown in FIGS. 11 and 13, albeit the first and second end panels 614, 616 have been omitted and the first and second side panels 618, 620; 718, 720 also have been omitted.

The blank 810 comprises four first article retention structures RT1 which are substantially similar in construction to the first article retention structures RT1 of the illustrated embodiments shown in FIGS. 11 and 13 albeit the abutment tabs 642, 644, that extend from the first and second end panels 614, 616 or from the first and second side panels 618, 629; 718, 720, have been omitted and replaced with a cutaway in the form of a recess C4, C5. The recesses C4, C5 are flanked by a pair of transition teeth or tabs 840*c*, 850*c*, a transition tab 840*c*, 850*c* being disposed on each side of the recess C4, C5. The transition tab 840*c*, 850*c* may be shaped to provide a gradual or curvilinear transition between the recess C4, C5 and the engaging edges of the first teeth 840*a*. The transition tabs 840*c*, 850*c* may comprise an inclined side edge. The transition tabs 840*c*, 850*c* may comprise rounded or filleted corners adjacent to the respective recess C4, C5 which it flanks.

The first article retention structures RT1 each comprise two recesses C4, C5 and two engaging teeth 840*c* disposed therebetween, the two engaging teeth 840*c* may be each smaller or narrower in width, angular width, at least along an engaging edge, than first teeth 840*a*. The two engaging teeth 840*c* are disposed across or adjacent to, and/or define, a corner region 812*a* of the main panel 812. In other embodiments, more than two engaging teeth 840*a*, 840*c* may be disposed between the pair of recesses C4, C5.

The blank 810 comprises two second article retention structures RT2 which are substantially similar in construction to the first article retention structures RT1, albeit one of the recesses C5 and the associated pair of transition tabs 840*c* have been omitted and replaced with four first engaging teeth 840*a*.

Further the arrangement of the radial cutlines 841, 851 of the first and second article retention structures RT1, RT2 has been modified such that the arrangement is rotated about a centre of the respective aperture A1, A2. The arrangement is rotated through an angle equivalent to half of the angular width of the first teeth 840*a*, 850*a*, which in the illustrated embodiment is about 12.25°. In the first article retention structures RT1 the radial cutline 841 separating the pair of transition tabs 840*c* disposed between a first recess C4 and a second recess C5 is oriented such that it bisects the angle between the end edge $E_e$ and the side edge $E_s$. A notional line N1 passing through the radial cutline 841 separating said pair of transition tabs 840*c* intersects a corner or vertex, real or notional, defined by the end edge $E_e$ and the side edge $E_s$ of the main panel 812.

The blanks 10; 110; 210; 310; 510; 610; 710; 810 include at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 27 point (pt.) SBS board (solid bleached sulphate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The blanks 10; 110; 210; 310; 510; 610; 710; 810 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g., MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The present disclosure provides a carrier 90; 190; 390; 490; 690; 790; 890 of the top engaging type having article retention structures RT1, RT2 for engaging articles B.

The carrier 90; 190; 390; 490; 690; 790; 890 comprises a main panel 12; 112; 212; 312; 412; 512; 612; 712; 812 having one or more article retention structures RT1, RT2 for receiving and securing the main panel 12; 112; 212; 312; 412; 512; 612; 712; 812 to a respective article B. The carrier 90; 190; 390; 490; 690; 790 comprises a pair of opposing side panels 18, 20; 118, 120; 218, 220; 318, 320; 418, 420; 518, 520; 618, 620; 718, 720 hingedly connected to the main panel 12; 112; 212; 312; 412; 512; 612; 712 by a hinged connection.

The carrier 90; 190; 390; 490; 690; 790 may comprise a pair of opposing end panels 14, 16; 114, 116; 214, 216; 314, 316; 414, 416; 514, 516; 614, 616; 714, 716 hingedly connected to the main panel 12; 112; 212; 312; 412; 512; 612; 712 by a hinged connection.

The carrier 90; 190; 390; 490; 690; 790 may comprise a first side panel 18; 118; 218; 318; 418; 518; 618; 718 hingedly connected to the main panel 12; 112; 212; 312; 412; 512; 612; 712 by a first hinged connection and a first end panel 14; 114; 214; 314; 414; 514; 614 hingedly connected to the main panel 12; 112; 212; 312; 412; 512; 612; 712 by a second hinged connection. A portion 17*a*; 117*a*; 217*a*; 317*a*; 417*a*; 517*a*; 617*a*; 717*a* of the first hinged connection and a portion 13*a*; 113*a*; 213*a*; 313*a*; 413*a*; 513*a*; 613*a* of the second hinged connection define, at least in part, a corner portion 12*a*; 112*a*; 212*a*; 312*a*; 412*a*; 512*a*; 612*a*; 712*a* of the main panel 12; 112; 212; 312; 412; 512; 612; 712.

The portion 17*a*; 117*a*; 217*a*; 317*a*; 417*a*; 517*a*; 617*a*; 717*a* of the first hinged connection may be obliquely oriented, at least in part, with respect to the portion 13*a*; 113*a*; 213*a*; 313*a*; 413*a*; 513*a*; 613*a* of the second hinged connection. The corner portion 12*a*; 112*a*; 212*a*; 312*a*; 412*a*; 512*a*; 612*a*; 712*a* of the main panel 12; 112; 212; 312; 412; 512; 612; 712 may upturn or incline with respect to the main panel 12; 112; 212; 312; 412; 512; 612; 712.

One or both of the portion 17*a*; 117*a*; 217*a*; 317*a*; 417*a*; 517*a*; 617*a*; 717*a* of the first hinged connection and the portion 13*a*; 113*a*; 213*a*; 313*a*; 413*a*; 513*a*; 613*a* of the second hinged connection may be linear.

One or both of the portion 17*a*; 117*a*; 217*a*; 317*a*; 417*a*; 517*a*; 617*a*; 717*a* of the first hinged connection and the portion 13*a*; 113*a*; 213*a*; 313*a*; 413*a*; 513*a*; 613*a* of the second hinged connection may be nonlinear in shape and may be curvilinear.

A corner bumper panel 322*a*, 322*b*, 322*c*, 333*d* may be hingedly connected between an end of the one of the pair of opposing side panels 18, 20; 118, 120; 218, 220; 318, 320; 418, 420; 518, 520; 618, 620 and an adjacent end of one of the pair of opposing end panels 14, 16; 114, 116; 214, 216; 314, 316; 414, 416; 514, 516; 614, 616.

The corner bumper panel 322*a*, 322*b*, 322*c*, 333*d* may be separated from a corner portion 12*a*, 12*b*, 12*c*, 12*d*; 112*a*, 112*b*, 112*c*, 112*d*; 212*a*, 212*b*, 212*c*, 212*d*; 312*a*, 312*b*, 312*c*, 312*d*; 412*a*, 412*b*, 412*c*, 412*d*; 512*a*, 512*b*, 512*c*, 512*d*; 612*a*; 712*a* of the main panel 12; 112; 212; 312; 412; 512; 612; 712 by a cut line or severable line 329*a*, 329*b*, 329*c*, 329*d*.

The hinged connection between the main panel 12; 112; 212; 312; 412; 512; 612; 712 and a side panel 18, 20; 118, 120; 218, 220; 318, 320; 418, 420; 518, 520; 618, 620; 718, 720, or an end panel 14, 16; 114, 116; 214, 216; 314, 316; 414, 416; 514, 516; 614, 616, may be defined, at least in part, by a curved or arcuate fold line 13, 15, 17, 19.

The article retention structures RT1, RT2 each comprise a plurality of engaging teeth 40*a*, 40*b*, 40*c*, 50*a*, 50*b*, 50*c*; 140*a*, 140*b*, 140*c*, 150*a*, 150*b*, 150*c*; 240*a*, 240*b*, 240*c*, 250*a*, 250*b*, 250*c*; 340*a*, 340*b*, 340*c*, 350*a*, 350*b*, 350*c*; 440, 450*a*, 450*b*, 450*c*; 540*a*, 540*b*, 540*c*, 550*a*, 550*b*, 550*c*; 640*a*, 640*c*, 650*a*, 650*c*; 740*a*, 740*c*, 750*a*, 750*c* for engaging an article B.

At least some of the teeth 40*a*, 40*b*, 40*c*, 50*a*, 50*b*, 50*c*; 140*a*, 140*b*, 140*c*, 150*a*, 150*b*, 150*c*; 240*a*, 240*b*, 240*c*, 250*a*, 250*b*, 250*c*; 340*a*, 340*b*, 340*c*, 350*a*, 350*b*, 350*c*; 440, 450*a*, 450*b*, 450*c*; 540*a*, 540*b*, 540*c*, 550*a*, 550*b*, 550*c*; 640*a*, 640*c*, 650*a*, 650*c*; 740*a*, 740*c*, 750*a*, 750*c* may be adapted to support the article B when the carrier 90; 190; 390; 490; 690; 790 is under load—that is to say the articles B are being suspended for hung from the main panel 12; 112; 212; 312; 412; 512; 612; 712.

The article retention structures RT1, RT2 each comprise at least one abutment tab 42, 44, 54; 142, 144, 154; 242, 244, 254; 342, 344, 354; 442, 444, 454; 542, 544, 554; 642, 644, 654; 742, 744, 754. The abutment tab 42, 44, 54; 142, 144, 154; 242, 244, 254; 342, 344, 354; 442, 444, 454; 542, 544, 554 is integral with one of a side panel 18, 20; 118, 120; 218, 220; 318, 320; 418, 420; 518, 520 and an end panel 14, 16; 114, 116; 214, 216; 314, 316; 414, 416; 514, 516.

The plurality of engaging teeth 40*a*, 40*b*, 40*c*, 50*a*, 50*b*, 50*c*; 140*a*, 140*b*, 140*c*, 150*a*, 150*b*, 150*c*; 240*a*, 240*b*, 240*c*, 250*a*, 250*b*, 250*c*; 340*a*, 340*b*, 340*c*, 350*a*, 350*b*, 350*c*; 440, 450*a*, 450*b*, 450*c*; 540*a*, 540*b*, 540*c*, 550*a*, 550*b*, 550*c*; 640*a*, 640*c*, 650*a*, 650*c*; 740*a*, 740*c*, 750*a*, 750*c* is configured and arranged to engage an article B below a flange, rim or protrusion. Each of the plurality of engaging teeth 40*a*, 40*b*, 40*c*, 50*a*, 50*b*, 50*c*; 140*a*, 140*b*, 140*c*, 150*a*, 150*b*, 150*c*; 240*a*, 240*b*, 240*c*, 250*a*, 250*b*, 250*c*; 340*a*, 340*b*, 340*c*, 350*a*, 350*b*, 350*c*; 440, 450*a*, 450*b*, 450*c*; 540*a*, 540*b*, 540*c*, 550*a*, 550*b*, 550*c*; 640*a*, 640*c*, 650*a*, 650*c*; 740*a*, 740*c*, 750*a*, 750*c* comprises an engaging edge disposed opposite a hinged edge.

The abutment tab 42, 44, 54; 142, 144, 154; 242, 244, 254; 342, 344, 354; 442, 444, 454; 542, 544, 554 may be arranged to engage a side of a wall, flange, rim or protrusion of the article B. The abutment tab 42, 44, 54; 142, 144, 154; 242, 244, 254; 342, 344, 354; 442, 444, 454; 542, 544, 554 comprises an abutment face for abutting a portion of the article B.

The abutment tab 42, 44, 54; 142, 144, 154; 242, 244, 254; 342, 344, 354; 442, 444, 454; 542, 544, 554 comprises a free edge disposed opposite a hinged edge. In some embodiments, the free edge may be arranged to be disposed below a flange, rim, undercut, ridge or protrusion or other engagement feature of an article B, and may engage said article B to provide support thereto.

The curved or arcuate fold line 13, 15, 17, 19 may be arranged to converge or couple with a hinged connection between one of the teeth 40*a*, 40*b*, 40*c*, 50*a*, 50*b*, 50*c*; 140*a*, 140*b*, 140*c*, 150*a*, 150*b*, 150*c*; 240*a*, 240*b*, 240*c*, 250*a*, 250*b*, 250*c*; 340*a*, 340*b*, 340*c*, 350*a*, 350*b*, 350*c*; 440, 450*a*, 450*b*, 450*c*; 540*a*, 540*b*, 540*c*, 550*a*, 550*b*, 550*c*; 640*a*, 640*c*, 650*a*, 650*c*; 740*a*, 740*c*, 750*a*, 750*c* and the main panel 12; 112; 212; 312; 412; 512; 612; 712.

The hinged connection between the main panel 12; 112; 212; 312; 412; 512; 612; 712 and a side panel 18, 20; 118, 120; 218, 220; 318, 320; 418, 420; 518, 520; 618, 620; 718, 720, or an end panel 14, 16; 114, 116; 214, 216; 314, 316; 414, 416; 514, 516; 614, 616, may be defined, at least in part, by a linear fold line 513, 515, 517, 519. The side panel 18, 20; 118, 120; 218, 220; 318, 320; 418, 420; 518, 520; 618, 620; 718, 720 and/or an end panel 14, 16; 114, 116; 214, 216; 314, 316; 414, 416; 514, 516; 614, 616 comprises a free edge opposing the hinged connection, that is to say the free edge is free from connection to another panel. A hinged connection between one of the plurality of teeth 40*a*, 40*b*, 40*c*, 50*a*, 50*b*, 50*c*; 140*a*, 140*b*, 140*c*, 150*a*, 150*b*, 150*c*; 240*a*, 240*b*, 240*c*, 250*a*, 250*b*, 250*c*; 340*a*, 340*b*, 340*c*, 350*a*, 350*b*, 350*c*; 440, 450*a*, 450*b*, 450*c*; 540*a*, 540*b*, 540*c*, 550*a*, 550*b*, 550*c*; 640*a*, 640*c*, 650*a*, 650*c*; 740*a*, 740*c*, 750*a*, 750*c* and the main panel 12; 112; 212; 312; 412; 512; 612; 712 may be arranged to converge or couple with the linear fold line 513, 515, 517, 519. The article retention structures RT1, RT2 may each comprise an annular series of teeth or tabs 40*a*, 40*b*, 40*c*, 50*a*, 50*b*, 50*c*, 42, 44, 54; 140*a*, 140*b*, 140*c*, 150*a*, 150*b*, 150*c*, 142, 144, 154; 240*a*, 240*b*, 240*c*, 250*a*, 250*b*, 250*c*, 242, 244, 254; 340*a*, 340*b*, 340*c*, 350*a*, 350*b*, 350*c*, 342, 344, 354; 440, 450*a*, 450*b*, 450*c*, 442, 444, 454; 540*a*, 540*b*, 540*c*, 550*a*, 550*b*, 550*c*, 542, 544, 554 each struck, at least in part, from the main panel 12; 112; 212; 312; 412; 512 and defining, at least in part, an article receiving opening, the annular series comprising a first tooth or tab 42, 44, 54; 142, 144, 154; 242, 244, 254; 342, 344, 354; 442, 444, 454; 542, 544, 554 integral with one of a side panel 18, 20; 118, 120; 218, 220; 318, 320; 418, 420, 518, 520 and an end panel 14, 16; 114, 116; 214, 216; 314, 316; 414, 416; 514, 516 and disposed opposite a recess interrupting the annular series. The recess defining a gap or void in the annular series.

Embodiments of the disclosure provide an article retention structures RT1. RT2 for receiving an article B having an engagement feature such as but not limited to, a flange, rim, undercut, ridge or protrusion, the engagement feature having a circular cross-section. The article retention structures RT1, RT2 may each comprise a series of engaging teeth 40*a*, 40*b*, 40*c*, 50*a*, 50*b*, 50*c*; 140*a*, 140*b*, 140*c*, 150*a*, 150*b*, 150*c*; 240*a*, 240*b*, 240*c*, 250*a*, 250*b*, 250*c*; 340*a*, 340*b*, 340*c*, 350*a*, 350*b*, 350*c*; 440, 450*a*, 450*b*, 450*c*; 540*a*, 540*b*, 540*c*, 550*a*, 550*b*, 550*c*; 640*a*, 640*c*, 650*a*, 650*c*; 740*a*, 740*c*, 750*a*, 750*c*; 840*a*, 840*c*, 850*a*, 850*c* each struck, at least in part, from the main panel 12; 112; 212; 312; 412; 512; 612; 712; 812 and disposed about the perimeter of an article receiving aperture A1, A2. The series of teeth or tabs and article receiving aperture A1, A2 define an article receiving opening. The annular series of teeth comprises at least one group of teeth hingedly connected to the main panel 12; 112; 212; 312; 412; 512; 612; 712; 812, the group of teeth is hinged to the main panel 12; 112; 212; 312; 412; 512; 612; 712; 812 by a non-circular fold line. The fold line may be defined by a portion of an ellipse, superellipse, hyperellipse, squircle, or rounded square.

Figure 5A:
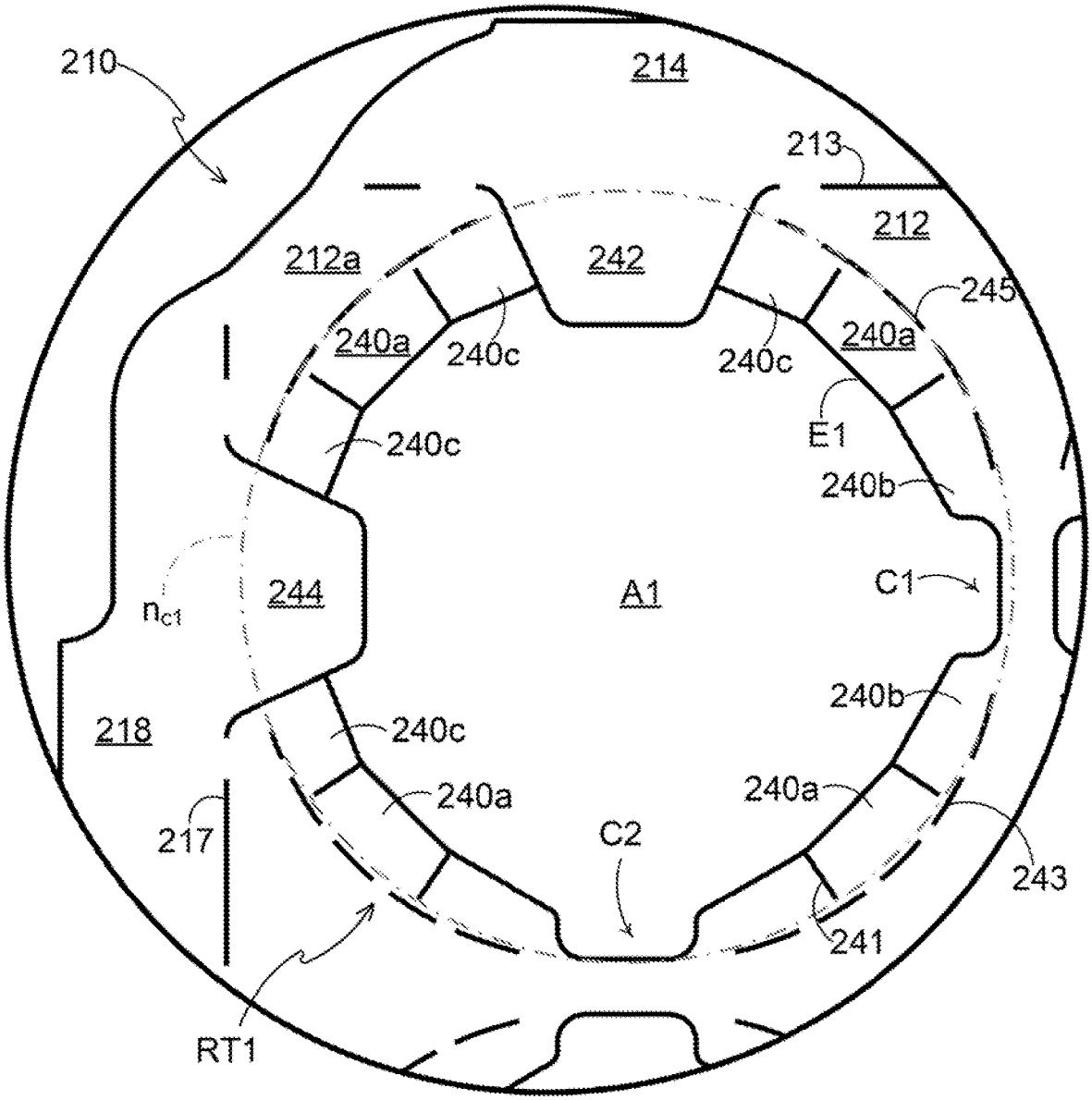
FIG. 5A is a plan view from above of a portion of the blank of FIG. 5 and shows a first retention structure.
Figure 5B:
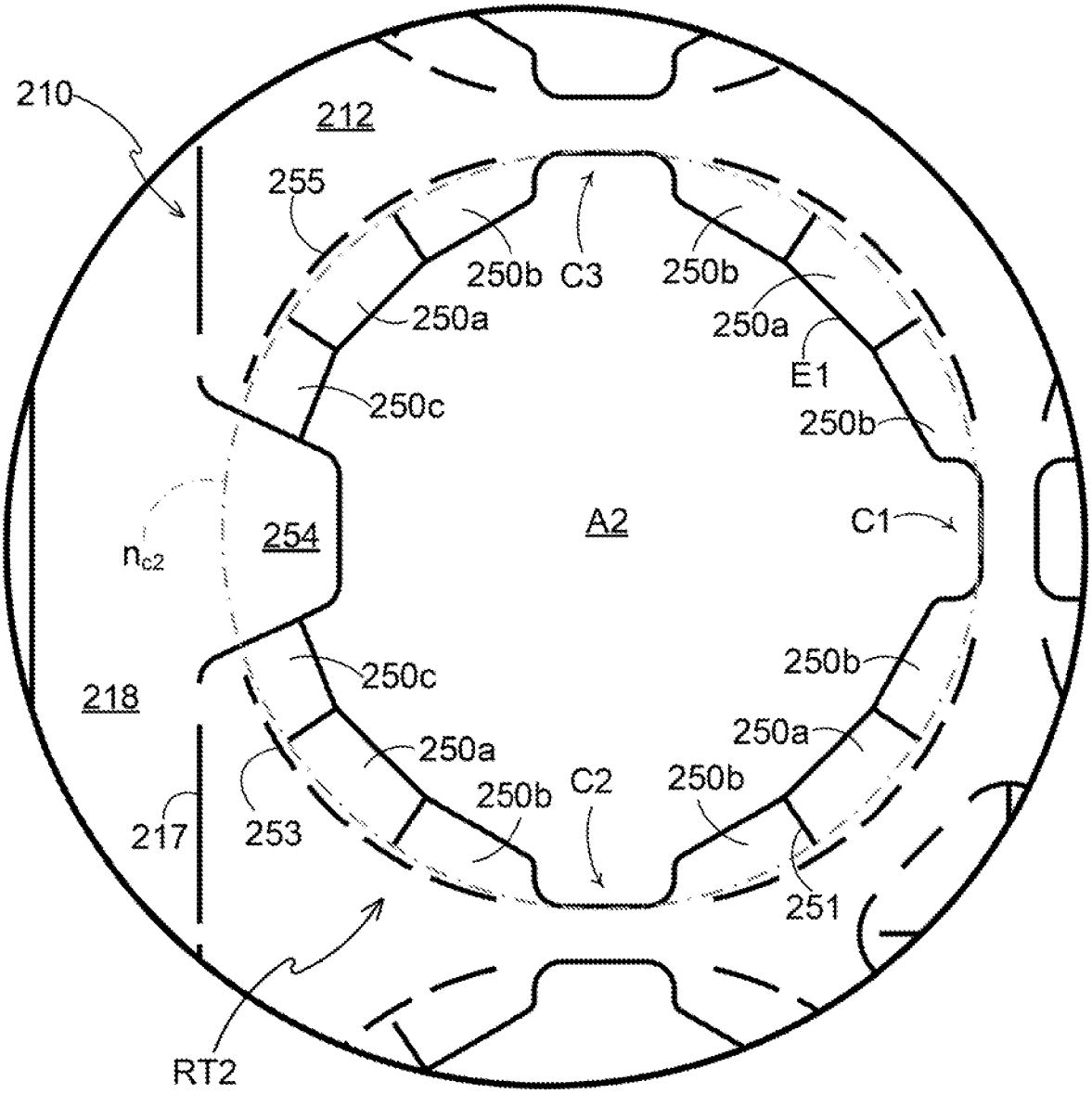
FIG. 5B is a plan view from above of a second portion of the blank of FIG. 5 and shows a second retention structure.

FIGS. 5A and 5B illustrate enlarged views of the first and second article retention structures of FIG. 5 respectively. FIG. 5A shows a first notional circle not centred on the aperture A1 and shows the deviation of the hinged connection between the teeth 240*a*, 240*b*, 240*c* and the main panel 212 from a circular shape. It will be appreciated that the hinged connection defines a perimeter of the article receiving opening, and that the article receiving opening deviates from a perfect circle. At least a portion of the article receiving opening or hinged connection may be defined by a superellipse, a hyperellipse or a squircle; said portion can be considered to have rounded corners. The first article retention device RT1 comprises at least one or two such rounded corners.

FIG. 5B shows a second notional circle $n_{c2}$ centred on the aperture A2 and shows the deviation of the hinged connection between the teeth 250*a*, 250*b*, 250*c* and the main panel 212 from a circular shape. It will be appreciated that the hinged connection defines a perimeter of the article receiving opening, and that the article receiving opening deviates from a perfect circle. At least a portion of the article receiving opening or hinged connection may be defined by a superellipse, a hyperellipse or a squircle; said portion can be considered to have rounded corners. The second article retention device RT2 comprises four such rounded corners.

The article receiving openings are non-circular in shape. The article receiving openings are non-polygonal in shape—that is to say they do not comprise a finite number of straight-line segments connected to form a closed polygonal chain.

The hinged connection between the plurality of engaging teeth 40*a*, 40*b*, 40*c*, 50*a*, 50*b*, 50*c*; 140*a*, 140*b*, 140*c*, 150*a*, 150*b*, 150*c*; 240*a*, 240*b*, 240*c*, 250*a*, 250*b*, 250*c*; 340*a*, 340*b*, 340*c*, 350*a*, 350*b*, 350*c*; 440, 450*a*, 450*b*, 450*c*; 540*a*, 540*b*, 540*c*, 550*a*, 550*b*, 550*c*; 640*a*, 640*c*, 650*a*, 650*c*; 740*a*, 740*c*, 750*a*, 750*c*; 840*a*, 840*c*, 850*a*, 850*c* and the main panel 12; 112; 212; 312; 412; 512; 612; 712; 812 is non-polygonal in shape.

The present disclosure also provides a carrier 90; 190; 390; 490; 690; 790; 890 of the top engaging type having article retention structures RT1, RT2 for engaging articles B. The carrier 90; 190; 390; 490; 690; 790; 890 comprises a main panel 12; 112; 212; 312; 412; 512; 612; 712; 812 having at least one article retention structure RT1 for receiving an article B and suspending the article B therefrom. The at least one article retention structure RT1 comprises an article receiving opening. The article receiving opening is defined, at least in part, by a first cutaway 44; 144; 244; 344; 444; 544; 644; 744; C5 adjacent to a longitudinal edge $E_s$ of the main panel 12; 112; 212; 312; 412; 512; 612; 712; 812 and by a second cutaway 42; 142; 242; 342; 442; 542; 642; C4 adjacent to a lateral edge $E_e$ of the main panel 12; 112; 212; 312; 412; 512; 612; 712; 812. The article retention structure RT1 comprises two or more tabs 40*a*, 40*c*; 140*a*, 140*c*; 240*a*, 240*c*; 340*a*, 340*c*; 440*a*; 540*a*, 540*c*; 640*a*, 640*c*; 740*a*, 740*c*; 840*c* disposed between the first and second cutaways.

The at least one of the first and second cutaways may be defined by a recess C4, C5 adjacent to a free or unhinged edge of the main panel 12; 112; 212; 312; 412; 512; 612; 712; 812.

The at least one of the first and second cutaways may be defined by an abutment tab 42, 44; 142, 144; 242, 244; 342, 344; 442, 444; 542, 544; 642, 644; 744 adjacent to a hinged edge of the main panel, the hinged edge being defined by a hinged connection between the main panel 12; 112; 212; 312; 412; 512; 612; 712; 812 and a second panel 14, 16, 18, 20:114.116, 118, 120; 214, 216, 218, 220; 314, 316, 318, 320:414, 416, 418, 420; 514, 516, 518, 520; 614, 616, 618, 620; 718, 720.

The abutment tab 42, 44; 142, 144; 242, 244; 342, 344; 442, 444; 542, 544; 642, 644; 744 may form an engaging tooth for supporting an article B disposed in the article retention structure.

The carrier 90; 190; 390; 490; 690; 790; 890 may comprise at least one second article retention structure RT2 disposed adjacent to the at least one article retention structure RT1. The at least one second article retention structure RT2 comprises a second article receiving opening struck from the main panel 12; 112; 212; 312; 412; 512; 612; 712; 812. The second article receiving opening is defined, at least in part, by a cutaway 44; 144; 244; 344; 444; 544; 644; 744; C5 adjacent to the longitudinal edge $E_s$ of the main panel 12; 112; 212; 312; 412; 512; 612; 712; 812 and wherein the article retention structure RT1 comprises two or more tabs 40*a*, 40*c*; 140*a*, 140*c*; 240*a*, 240*c*; 340*a*, 340*c*; 440*a*; 540*a*, 540*c*; 640*a*, 640*c*; 740*a*, 740*c*; 840*c* disposed about the second article receiving opening.

It can be appreciated that various changes may be made within the scope of the present invention. For example, the size and shape of the panels and apertures may be adjusted to accommodate articles of differing size or shape. The shoulder panels may be omitted. The present invention is not limited to cartons of the top-engaging type, the invention may be employed with other carton styles such as, but not limited to, open top crates, lidded or closed top crates.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutine, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article engaging carrier for packaging at least one article, the carrier comprising a main panel having at least one article retention structure for engaging an article, the carrier comprising a side panel hingedly connected to the main panel by a hinged connection, wherein the hinged connection between the main panel and the side panel is defined, at least in part, by an arcuate fold line, wherein the arcuate fold line defines a convex hinged connection.

2. An article carrier according to claim 1, wherein the main panel comprises two or more article retention structures and wherein the arcuate fold line extends between an adjacently disposed pair of article retention structures.

3. An article carrier according to claim 1, wherein the at least one article retention structure comprises a plurality of engaging teeth for engaging an article hingedly connected to the main panel by a second hinged connection and wherein the arcuate fold line converges with the second hinged connection.

4. An article carrier according to claim 1, wherein the at least one article retention structure comprises a plurality of engaging teeth for engaging an article hingedly connected to the main panel by a second hinged connection, the arcuate fold line is coupled to the second hinged connection between one of the plurality of engaging teeth and the main panel by a crease line.

5. An article carrier according to claim 1, wherein a first abutment tab struck, at least in part, from the main panel and integral with the side panel defines a portion of an article receiving opening of the at least one article retention structure, the arcuate fold line converges with the article receiving opening proximate the first abutment tab.

6. An article carrier according to claim 5, wherein an article engaging tooth is disposed adjacent to the first abutment tab, the article engaging tooth being struck, at least in part, from the main panel and hinged thereto by a second hinged connection, the arcuate fold line converges with the second hinged connection proximate the abutment tab.

7. An article carrier according to claim 5, wherein the carrier comprises an end panel hingedly connected to the main panel, at least in part, by a second arcuate fold line.

8. An article carrier according to claim 7, wherein a second abutment tab is struck, at least in part, from the main panel and is integral with the end panel, the second abutment tab defines a portion of an article receiving opening of the at least one article retention structure, the second arcuate fold line converges with the article receiving opening proximate the second abutment tab.

9. An article carrier according to claim 8, wherein the second abutment tab is perpendicular to the first abutment tab.

10. An article engaging carrier for packaging at least one article, the carrier comprising a main panel having at least one article retention structure for engaging an article, the carrier comprising a side panel hingedly connected to the main panel by a first hinged connection and an end panel hingedly connected to the main panel adjacent to the side panel by a second hinged connection, a portion of the first hinged connection and a portion of the second hinged connection define, at least in part, a corner portion of the main panel, wherein the portion of the first hinged connection is obliquely oriented, at least in part, with respect to the portion of the second hinged connection.

11. An article carrier according to claim 10, wherein the at least one article retention structure comprises an article receiving opening disposed adjacent to the side and end panels and wherein the portion of the first hinged connection extends between an end of the side panel and the article receiving opening and a portion of the second hinged connection extends between an end of the end panel and the article receiving opening.

12. An article carrier according to claim 10, wherein the corner portion of the main panel is inclined with respect to the main panel.

13. An article carrier according to claim 10, wherein one or both of the portion of the first hinged connection and the portion of the second hinged connection is linear, or both of the portions of the first hinged connection and the second hinged connections are linear.

14. An article carrier according to claim 10, wherein the portion of the first hinged connection and the portion of the second hinged connection define an angle therebetween, the angle is greater than 90°.

15. An article engaging carrier for packaging at least one article, the carrier comprising a first panel having at least one article retention structure for receiving an article and a second panel hingedly connected to the first panel, the at least one article retention structure comprising an article receiving opening, wherein the at least one article retention structure comprises a plurality of engaging teeth disposed about the article receiving opening, wherein the article receiving opening is defined, at least in part, by an abutment tab integral with the second panel.

16. An article carrier according to claim 15, wherein the abutment tab is arranged to engage a side portion of an article.

17. An article carrier according to claim 15, wherein the abutment tab comprises an abutment face for abutting a portion of the article.

18. An article carrier according to claim 15, wherein the abutment tab comprises a free edge disposed opposite an edge of the second panel, the free edge being arranged to be disposed below an engagement feature of an article to provide support thereto.

19. An article carrier according to claim 15, wherein the plurality of engaging teeth is a series of article retention structure-comprises engaging teeth each struck, at least in part, from the main panel and disposed about the perimeter of an article receiving aperture defined in the first panel, the series of teeth and article receiving aperture defining, at least in part, the article receiving opening.

20. An article carrier according to claim 19, wherein the series of engaging teeth comprise an engaging edge disposed opposite an edge of the second panel for engaging an article below an engagement feature of an article.

21. An article carrier according to claim 15, wherein the abutment tab comprises an engaging edge opposing an edge of the second panel, the engaging edge being arranged to engage an article when received in the at least one article retention structure.

22. An article carrier according to claim 15, wherein the plurality of engaging teeth comprises at least two teeth having different widths.

23. An article carrier according to claim 22, wherein the abutment tab forms an engaging tooth and has a different width to either of the at least two teeth.

24. An article carrier according to claim 15, wherein the plurality of engaging teeth comprises three first teeth and a pair of second teeth, the three first teeth being disposed between the pair of second teeth, and wherein the second teeth have a larger width than the first teeth.

25. An article carrier according to claim 24, wherein the abutment tab forms one of the pair of second teeth.

26. An article carrier according to claim 25, wherein the article engaging carrier further comprises a third panel hingedly connected to the first panel and disposed adjacent to the second panel, and wherein the article receiving opening is defined, at least in part, by a second abutment tab integral with the third panel.

27. An article carrier according to claim 26, wherein the second abutment tab forms a second one of the pair of second teeth.

28. An article carrier according to claim 15, wherein each of the plurality of engaging teeth is defined by at least one first radial cutline, and the plurality of engaging teeth defines a circumferential fold line surrounding the article receiving opening and defining an outer perimeter thereof, and wherein the abutment tab is defined by at least one second radial cutline, the second radial cut line extending into the engaging panel beyond the outer perimeter defined by the circumferential fold line.

29. An article carrier according to claim 15, wherein a hinged connection between the first panel and the second panel is defined, at least in part, by a plurality of cuts, the plurality of cuts including at least two, three or more cuts of different lengths.

30. An article carrier according to claim 29, wherein the plurality of cuts is provided between an abutment tab of a first article retention structure and an abutment tab of a second article retention structure.

31. An article engaging carrier for packaging at least one article, the carrier comprising a first panel having at least one article retention structure for receiving an article and a second panel hingedly connected to the first panel, the at least one article retention structure comprising a series of engaging teeth each struck, at least in part, from the first panel and disposed about the perimeter of an article receiving aperture, wherein the series comprises a first tab integral with the second panel and disposed opposite a recess interrupting the series of engaging teeth.

32. An article carrier according to claim 31, wherein the recess defines a gap in the series of engaging teeth.

33. An article engaging carrier for packaging at least one article, the carrier comprising a main panel having at least one article retention structure for receiving an article having an engagement feature of circular cross-section, the at least one article retention structure comprising a series of engaging teeth each struck, at least in part, from the main panel and disposed about the perimeter of an article receiving aperture, the series of teeth and article receiving aperture define an article receiving opening, the series of teeth comprising at least one group of teeth hingedly connected to the main panel, wherein the group of teeth is hinged to the main panel by a non-circular fold line.

34. An article carrier according to claim 33, wherein the fold line is defined by a portion of one of the shapes selected from the following group: an ellipse, superellipse, hyperellipse, squircle, and rounded square.

35. An article carrier according to claim 33, wherein the non-circular fold line is non-polygonal.

36. A blank for forming an article carrier, the blank comprising a main panel having at least one article retention structure for engaging an article, the blank comprising a side panel hingedly connected to the main panel by a hinged connection, wherein the hinged connection between the main panel and the side panel is defined, at least in part, by an arcuate fold line, wherein the arcuate fold line defines a convex hinged connection.

37. A blank for forming an article carrier, the blank comprising a main panel having at least one article retention structure for engaging an article, the blank comprising a side panel hingedly connected to the main panel by a first hinged connection, and an end panel hingedly connected to the main panel adjacent to the side panel by a second hinged connection, a portion of the first hinged connection and a portion of the second hinged connection define, at least in part, a corner portion of the main panel, wherein the portion of the first hinged connection is obliquely oriented, at least in part, with respect to the portion of the second hinged connection.

38. A blank for forming an article carrier, the blank comprising a first panel having at least one article retention structure for receiving an article and a second panel hingedly connected to the first panel, the at least one article retention structure comprising an article receiving opening, wherein the at least one article retention structure comprises a plurality of engaging teeth disposed about the article receiving opening, wherein the article receiving opening is defined, at least in part, by an abutment tab integral with the second panel.

39. A blank for forming an article carrier, the blank comprising a first panel having at least one article retention structure for receiving an article and a second panel hingedly connected to the first panel, the at least one article retention structure comprising a series of engaging teeth each struck, at least in part, from the first panel and disposed about the perimeter of an article receiving aperture, wherein the series comprises a first tab integral with the second panel and disposed opposite a recess interrupting the series of engaging teeth.

40. A blank for forming an article carrier, the blank comprising a main panel having at least one article retention structure for receiving an article having an engagement feature of circular cross-section, the at least one article retention structure comprising a series of engaging teeth each struck, at least in part, from the main panel and disposed about the perimeter of an article receiving aperture, the series of teeth and the article receiving aperture define an article receiving opening, the series of teeth comprising at least one a group of teeth hingedly connected to the main panel, wherein the group of teeth is hinged to the main panel by a non-circular fold line.

41. An article engaging carrier for packaging at least one article, the carrier comprising a main panel having at least one article retention structure for receiving an article and suspending the article therefrom, the at least one article retention structure comprising an article receiving opening, wherein the article receiving opening is defined, at least in part, by a first cutaway adjacent to a longitudinal edge of the main panel and by a second cutaway adjacent to a lateral edge of the main panel, wherein the article retention structure comprises two or more tabs disposed between the first and second cutaways.

42. An article carrier according to claim 41, wherein the at least one of the first and second cutaways is defined by a recess adjacent to a free unhinged edge of the main panel.

43. An article carrier according to claim 41, wherein the at least one of the first and second cutaways is defined by an abutment tab adjacent to a hinged edge of the main panel, the hinged edge being defined by a hinged connection between the main panel and a second panel.

44. An article carrier according to claim 43, wherein the abutment tab forms an engaging tab for supporting an article disposed in the article retention structure.

45. An article carrier according to claim 41, wherein the carrier comprises at least one second article retention structure disposed adjacent to the at least one article retention structure, the at least one second article retention structure comprises a second article receiving opening struck from the main panel, wherein the second article receiving opening is defined, at least in part, by a cutaway adjacent to the longitudinal edge of the main panel, and wherein the article retention structure comprises two or more tabs disposed about the second article receiving opening.

46. An article carrier according to claim 41, wherein at least one of the first and second cutaways is wider in dimension than the tabs.

47. An article carrier according to claim 41, wherein the two or more tabs disposed are disposed across a corner of the main panel.

48. An article carrier according to claim 41, wherein each of the two or more tabs forms an engaging tab for suspending an article disposed in the article retention structure.

49. A blank for forming an article carrier, the blank comprising a main panel having at least one article retention structure for receiving an article and suspending the article therefrom, the at least one article retention structure comprising an article receiving opening, wherein the article receiving opening is defined, at least in part, by a first cutaway adjacent to a longitudinal edge of the main panel and by a second cutaway adjacent to a lateral edge of the main panel, wherein the article retention structure comprises two or more tabs disposed between the first and second cutaways.

* * * * *